US010824108B2

(12) United States Patent
Iwai et al.

(10) Patent No.: US 10,824,108 B2
(45) Date of Patent: Nov. 3, 2020

(54) CLEANING MEMBER USED IN IMAGE FORMING APPARATUS INCLUDING OPTICAL PRINT HEAD, AND IMAGE FORMING APPARATUS INCLUDING OPTICAL PRINT HEAD

(71) Applicant: CANON KABUSHIKI KAISHA, Tokyo (JP)

(72) Inventors: Hitoshi Iwai, Abiko (JP); Shinichiro Hosoi, Tokyo (JP); Takehiro Ishidate, Tokyo (JP); Toshiki Momoka, Tokyo (JP); Daisuke Aruga, Abiko (JP); Ryota Fukumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/810,673

(22) Filed: Mar. 5, 2020

(65) Prior Publication Data

US 2020/0292984 A1 Sep. 17, 2020

(30) Foreign Application Priority Data

Mar. 13, 2019 (JP) ..... 2019-046341

(51) Int. Cl.
*G03G 21/00* (2006.01)
*G03G 15/04* (2006.01)

(52) U.S. Cl.
CPC ..... *G03G 21/0047* (2013.01); *G03G 15/04* (2013.01)

(58) Field of Classification Search
CPC ..... G03G 15/04054; G03G 2215/0409; G03G 21/0047; G03G 2221/0078
See application file for complete search history.

(56) References Cited

U.S. PATENT DOCUMENTS 8,269,812 B2 * 9/2012 Morimoto ..... G02B 3/0056 347/242
2018/0364636 A1 12/2018 Imai

FOREIGN PATENT DOCUMENTS

EP 3306410 A 8/2004
JP H10-164289 A 6/1998
(Continued)

OTHER PUBLICATIONS

Nagase, JP 2004-226536 A, Aug. 2004, JPO Computer Translation (Year: 2004).*
(Continued)

*Primary Examiner* — Erika J Villaluna
(74) *Attorney, Agent, or Firm* — Canon U.S.A., Inc. IP Division

(57) ABSTRACT

A cleaning member for use in an image forming apparatus and configured to be inserted into the apparatus, the apparatus comprising a holding body that holds a substrate and lenses, the cleaning member comprising a rod, a cleaning portion provided in the rod to clean a light emission surface of each lens, a magnet attached to the rod, the magnet emitting a magnetic field to generates a magnetic force to draw the holding body thereto so that the cleaning portion maintains contact with the light emission surface, a yoke member attached to the rod and in contact with the magnet. The yoke member is configured to protrude, with respect to the magnet, towards a side on which the holding body is disposed, and a contact portion that is configured to contact the holding body and that to protrude, with respect to the yoke member, towards the above side.

15 Claims, 20 Drawing Sheets

(56) References Cited

FOREIGN PATENT DOCUMENTS

| | | | |
|---|---|---|---|
| JP | 2004-226536 | A | 8/2004 |
| JP | 2006-106446 | A | 4/2006 |
| JP | 2019-3113 | A | 1/2019 |
| JP | 2019-003114 | A | 1/2019 |

OTHER PUBLICATIONS

Translation of JP 2006-106446.
Translation of JP10-164289.

* cited by examiner

CLEANING MEMBER USED IN IMAGE FORMING APPARATUS INCLUDING OPTICAL PRINT HEAD, AND IMAGE FORMING APPARATUS INCLUDING OPTICAL PRINT HEAD

BACKGROUND OF THE INVENTION

Field of the Invention

The present invention relates to a cleaning member used in an image forming apparatus including an optical print head, and an image forming apparatus including an optical print head.

Description of the Related Art

There are image forming apparatuses, such as a printer and a copier, that use an optical print head including a plurality of light emitting elements that expose a photosensitive drum. There are optical print heads that use, as an example of the light emitting elements, light emitting diodes (LEDs), organic electroluminescences (organic ELs), or the like. A plurality of light emitting elements are aligned along a rotational axis direction of the photosensitive drum in a single line or in two staggered lines, for example. Furthermore, the optical print head includes a lens array that collects the light emitted from the light emitting elements to the photosensitive drum. The lens array is disposed between the light emitting elements and the photosensitive drum so as to oppose the photosensitive drum. The light emitted from the light emitting elements is collected to a surface of the photosensitive drum through the lens array. An electrostatic latent image is formed on the photosensitive drum in the above manner.

Since the lens array included in the optical print head is located near the photosensitive drum, toner and foreign substances such as paper dust tend to adhere to a light emission surface of the lens array. When the light emission surface of the lens array becomes unclean with foreign substances, a decrease in image quality such as image unevenness may occur. Accordingly, a device that cleans the light emission surface of the lens array has been proposed. An example of a cleaning device is disclosed in Japanese Patent Laid-Open No. 2019-3113.

A protruded portion is formed in a housing (a holding body) of an optical print head disclosed in Japanese Patent Laid-Open No. 2019-3113, and an engagement portion formed in the cleaning member is engaged with the protruded portion. By engaging the engagement portion formed in the cleaning member and the protruded portion formed in the holding body with each other, a state in which a rubbing portion (a cleaning portion) formed in the cleaning member and the light emission surface of the lens array are in contact with each other is maintained. The cleaning portion can reliably clean the light emission surface of the lens by having the operator insert and remove the cleaning member into and from a main body of the image forming apparatus while the engagement portion formed in the cleaning member and the protruded portion formed in the holding body are engaged with each other.

By having the holding body of the optical print head be formed of metal, the rigidity of the holding body may become increased. However, when the holding body is formed of metal, compared with when formed of resin, it is not easy to process the shape of the holding body into a shape allowing the engagement portion formed in the cleaning member to engage therewith. Accordingly, consideration of providing a magnet on the cleaning member when the holding body is formed of metal has been made. The state in which the cleaning portion of the cleaning member and the light emission surface of the lens array are in contact with each other is maintained using the force that draws the magnet and the holding body towards each other. Yokes are provided in the cleaning member to control the orientation of the magnetic flux emitted from the magnet. Since the yokes are provided in the cleaning member so as to be in contact with the magnet, the yokes are magnetized by the magnetic flux emitted by the magnet. When the cleaning member is inserted from the outside of the main body of the image forming apparatus, the yokes described above come in contact with the holding body. The cleaning member is inserted into and removed from the main body of the image forming apparatus by the user while the holding body and the magnetized yokes draw each other towards each other and are in contact with each other.

However, when the cleaning member is inserted into and removed from the main body of the image forming apparatus while the yokes and the metal holding body are in contact with each other, the surfaces of the yokes and the surface of the holding body may become scraped.

SUMMARY OF THE INVENTION

A cleaning member according to an aspect of the present invention that is used in an image forming apparatus and configured to be inserted into the image forming apparatus from outside the image forming apparatus, the image forming apparatus including a holding body comprising a metal magnetic body holding a substrate on which a plurality of light emitting elements configured to emit light to expose a photosensitive drum are aligned in a rotational axis direction of the photosensitive drum and holding lenses configured to collect the light emitted from the light emitting elements to the photosensitive drum, the cleaning member including a rod formed of resin, a cleaning portion attached to the rod to clean a light emission surface of each lens, the cleaning portion configured to move together with the rod on insertion of the cleaning member into the image forming apparatus and to oppose the light emission surface in an optical axis direction of the lenses, a magnet attached to the rod, the magnet emitting a magnetic field to generate a magnetic force to draw the holding body thereto, in the case that the cleaning member is inserted in the image forming apparatus, so that the cleaning portion opposing the light emission surface maintains contact with the light emission surface, a yoke member attached to the rod and in contact with the magnet, in which in a state in which the cleaning member is inserted in the image forming apparatus, the yoke member is configured to protrude, with respect to the magnet, in a direction of an optical axis of the lenses towards a side on which the holding body is disposed, and a contact portion configured, in the state in which the cleaning member is inserted in the image forming apparatus, to protrude, with respect to the yoke member, in the optical axis direction towards the side on which the holding body is disposed, and configured to be in contact with the holding body.

Furthermore, an image forming apparatus according to another aspect of the present invention includes a photosensitive drum configured to rotate, a holding body comprising a metal magnetic body holding a substrate on which a plurality of light emitting elements configured to emit light to expose the photosensitive drum are aligned in a rotational axis direction of the photosensitive drum and holding lenses configured to collect the light emitted from the light emitting elements to the photosensitive drum, and an insertion portion configured to receive a cleaning member inserted from outside the image forming apparatus, the cleaning member including a rod formed of resin, a cleaning portion attached to the rod to clean a light emission surface of each lens, the cleaning portion configured to move together with the rod on insertion of the cleaning member into the image forming apparatus and to oppose the light emission surface in an optical axis direction of the lenses, a magnet attached to the rod, the magnet emitting a magnetic field to generate a magnetic force to draw the holding body thereto, in the case that the cleaning member is inserted in the image forming apparatus, so that the cleaning portion opposing the light emission surface maintains contact with the light emission surface, a yoke member attached to the rod and in contact with the magnet, in which in a state in which the cleaning member is inserted in the image forming apparatus, the yoke member is configured to protrude, with respect to the magnet, in a direction of an optical axis of the lenses towards a side on which the holding body is disposed, and a contact portion configured, in the state in which the cleaning member is inserted in the image forming apparatus, to protrude, with respect to the yoke member, in the optical axis direction towards the side on which the holding body is disposed, and configured to be in contact with the holding body. In the image forming apparatus, in an insertion direction of the cleaning member, the insertion portion is provided upstream of a light emission surface of the light emitting elements.

Further features of the present invention will become apparent from the following description of embodiments with reference to the attached drawings.

BRIEF DESCRIPTION OF THE DRAWINGS

FIGS. 4A to 4C2 are diagrams illustrating a configuration of a substrate, and a lens array.

DESCRIPTION OF THE EMBODIMENTS

Hereinafter, configurations embodying the present invention will be described with reference to the drawings. Note that the dimensions, the materials, the shapes, and the relative positions of the components described hereinafter are not intended to limit the present invention solely thereto unless explicitly stated.

Image Forming Apparatus

Figure 1A:
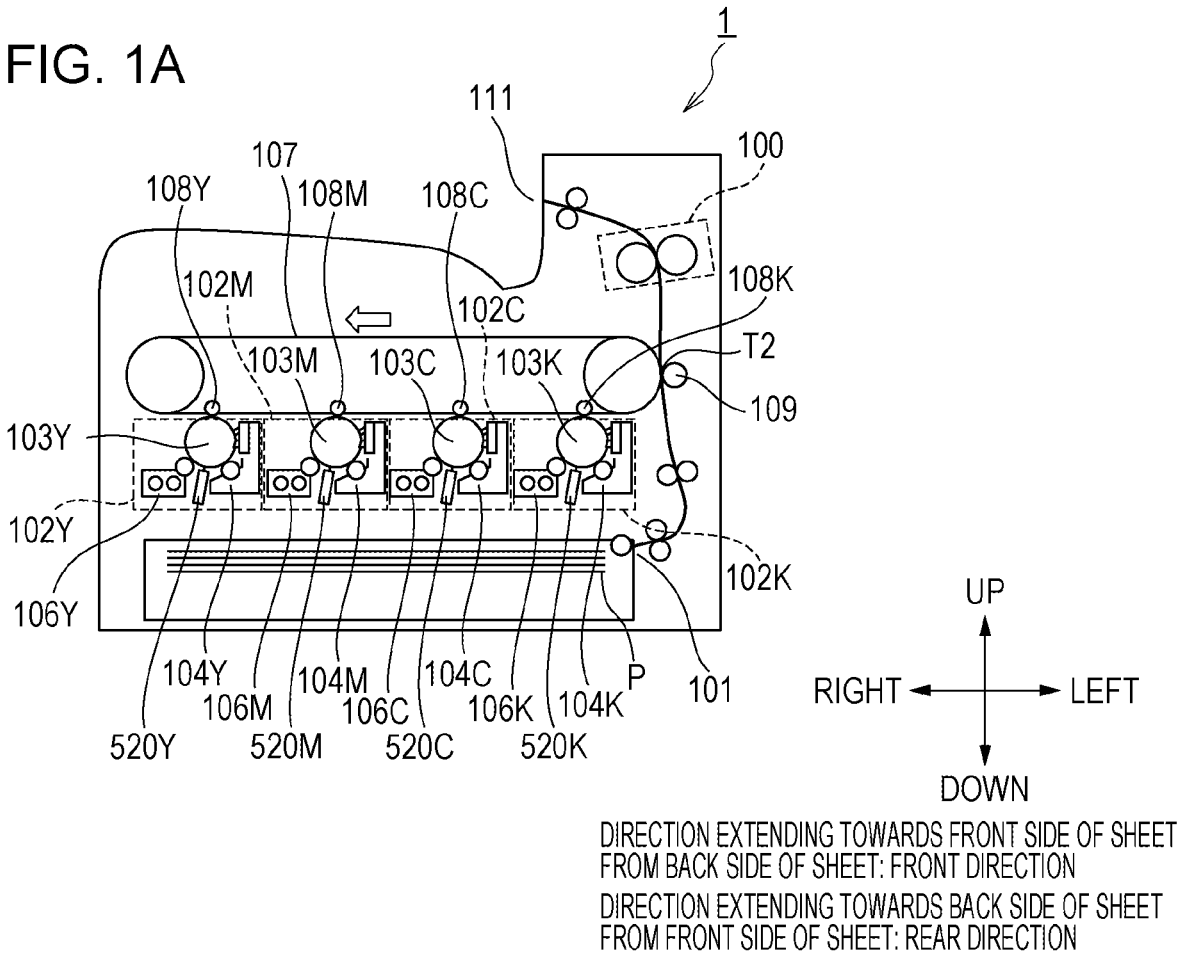
FIGS. 1A and 1B are cross-sectional views schematically illustrating an image forming apparatus.

A schematic configuration of an image forming apparatus 1 will be described first. FIG. 1A is a schematic cross-sectional view of the image forming apparatus 1. While the image forming apparatus 1 illustrated in FIG. 1A is a color printer (a single function printer or an SFP) that does not include a reader, the image forming apparatus may be a copier that includes a reader. Furthermore, the image forming apparatus is not limited to a color image forming apparatus that includes a plurality of photosensitive drums 103 as illustrated in FIG. 1A and may be a color image forming apparatus that includes a single photosensitive drum 103 or an image forming apparatus that forms a monochrome image.

The image forming apparatus 1 illustrated in FIG. 1A includes four image forming units 102Y, 102M, 102C, and 102K (hereinafter, also collectively referred to as merely "image forming units 102") that form toner images of various colors, namely, yellow, magenta, cyan, and black. Furthermore, the image forming units 102Y, 102M, 102C, and 102K include photosensitive drums 103Y, 103M, 103C, and 103K (hereinafter, also collectively referred to as merely "photosensitive drums 103"), respectively. The image forming units 102Y, 102M, 102C, and 102K further include chargers 104Y, 104M, 104C, and 104K (hereinafter, also collectively referred to as merely "chargers 104") that charge the photosensitive drums 103Y, 103M, 103C, and 103K, respectively. The image forming units 102Y, 102M, 102C, and 102K further include light emitting diode (LED) exposure units 520Y, 520M, 520C, and 520K (hereinafter, also collectively referred to as merely "exposure units 520") serving as exposure light sources that emit light that exposes the photosensitive drums 103Y, 103M, 103C, and 103K. Furthermore, the image forming units 102Y, 102M, 102C, and 102K include developing devices 106Y, 106M, 106C, and 106K (hereinafter, also collectively referred to as merely "developing devices 106") that develop the electrostatic latent images on the photosensitive drums 103 with toner. The developing devices 106 are developing members that develop toner images of various colors on the photosensitive drums 103. Note that Y, M, C, and K attached to the reference numerals indicate the colors of the toner.

Figure 1B:
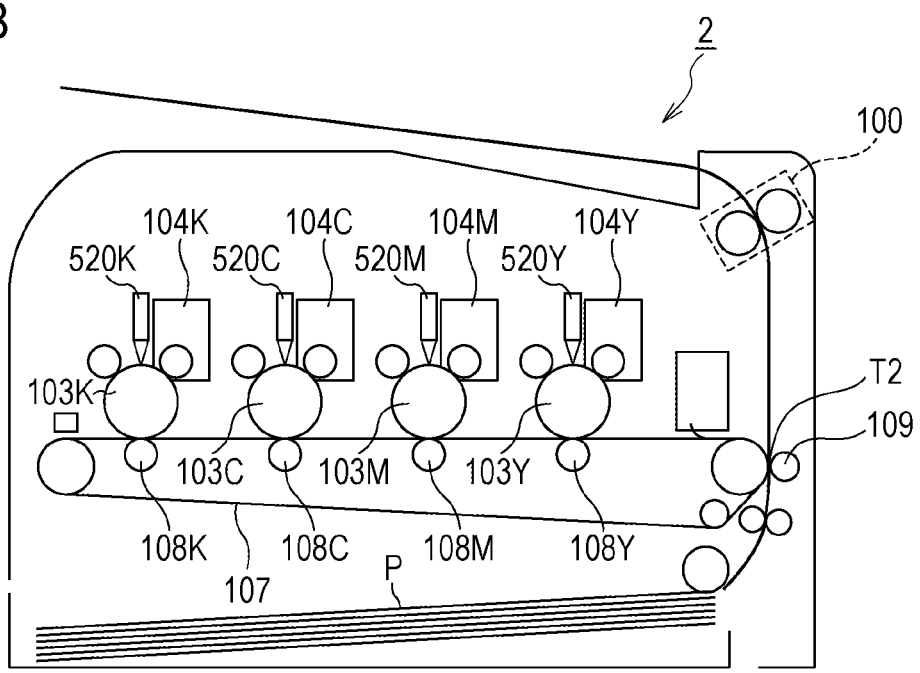

The image forming apparatus 1 illustrated in FIG. 1A is an image forming apparatus that adopts a so-called "lower surface exposing method" that exposes the photosensitive drums 103 from below. Hereinafter, the description will be given on the premise that the image forming apparatus adopts the lower surface exposing method; however, the image forming apparatus may adopt an "upper surface exposing method" that exposes the photosensitive drum 103 from above such as in an image forming apparatus 2 illustrated in FIG. 1B. In FIG. 1B, portions that present configurations that are the same as those in FIG. 1A will be indicated with the same reference numerals.

The image forming apparatus 1 includes an intermediate transfer belt 107 to which the toner images formed on the photosensitive drums 103 are transferred, and primary transfer rollers 108 (Y, M, C, and K) that sequentially transfer the toner images formed on the photosensitive drums 103 to the intermediate transfer belt. Furthermore, the image forming apparatus 1 includes a secondary transfer roller 109 that serves as a transfer member that transfers the toner images on the intermediate transfer belt 107 onto a sheet of recording paper P conveyed from a feeding unit 101, and a fixing unit 100 that fixes the secondarily transferred images to the recording paper P.

Image Forming Process

The exposure unit 520Y exposes a surface of the photosensitive drum 103Y that has been charged with the charger 104Y. With the above, an electrostatic latent image is formed on the photosensitive drum 103Y. Subsequently, the developing device 106Y develops the electrostatic latent image formed on the photosensitive drum 103Y with yellow toner. The yellow toner image developed on the surface of the photosensitive drum 103Y is transferred onto the intermediate transfer belt 107 with the primary transfer roller 108Y. The magenta, cyan, and black toner images are transferred to the intermediate transfer belt 107 through a similar image forming process.

Each of the toner images transferred on the intermediate transfer belt 107 is conveyed to a secondary transfer portion T2 with the intermediate transfer belt 107. A transfer bias that transfers the toner images to the recording paper P is applied to the secondary transfer roller 109 disposed in the secondary transfer portion T2. The transfer bias of the secondary transfer roller 109 transfers the toner images, which has been conveyed to the secondary transfer portion T2, onto a recording paper P, which has been conveyed from the feeding unit 101. The recording paper P on which the toner images have been transferred is conveyed to the fixing unit 100. The fixing unit 100 fixes the toner images to the recording paper P with heat and pressure. The recording paper P to which fixing has been performed with the fixing unit 100 is discharged to a sheet discharge portion 111.

Drum Unit and Developing Unit

Drum units 518Y, 518M, 518C, and 518K (hereinafter, also collectively referred to as merely "drum units 518") that include the photosensitive drums 103 are attached to the image forming apparatus 1. The drum units 518 are cartridges that are replaced by an operator such as a user or maintenance personnel. The drum units 518 rotatably support the photosensitive drums 103. Specifically, the photosensitive drums 103 are rotatably supported by frames of the drum units 518. Note that the drum units 518 do not have to be configured to include the chargers 104 and cleaning devices.

Furthermore, developing units 641Y, 641M, 641C, and 641K (hereinafter, also collectively referred to as merely "developing units 641") that are members different from the drum unit 518 are attached to the image forming apparatus 1 of the present embodiment. The developing unit 641 of the present embodiment is a cartridge that is an integrated member of the developing device 106 illustrated in FIG. 1A and a storage portion. The developing device 106 includes a developing sleeve (not shown) that carries developer. The developing unit 641 is provided with a plurality of gears that rotate a screw that mixes the toner and a carrier. When there is aging degradation or the like in the gears, the operator detaches the developing unit 641 from an apparatus main body of the image forming apparatus 1 and replaces the developing unit 641. Note that the drum unit 518 and the developing unit 641 are not limited to the configuration of the embodiment and may be a process cartridge that is an integrated member of the drum unit 518 and the developing unit 641 described above.

Figure 2A:
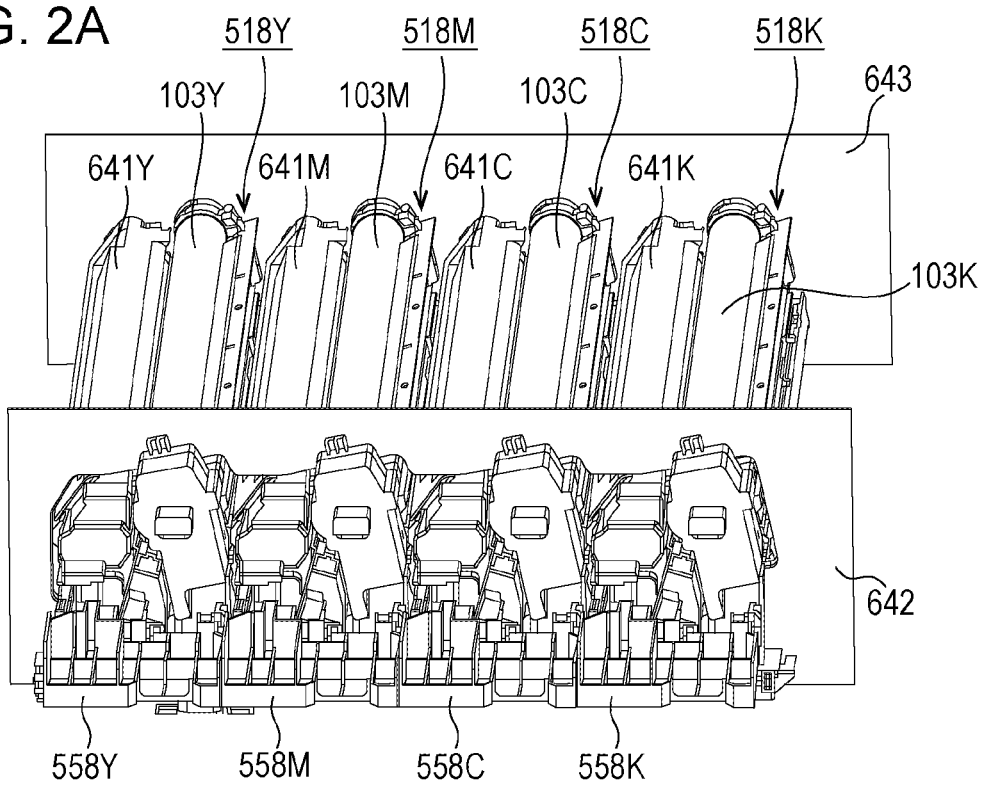
FIGS. 2A and 2B are diagrams illustrating a structure around drum units and developing units in the image forming apparatus.

FIG. 2A is a perspective view illustrating a schematic structure around the drum units 518 and the developing units 641 included in the image forming apparatus 1. Furthermore, FIG. 2B is a diagram illustrating a state in which the drum unit 518 is inserted into the image forming apparatus 1 from the outside of the apparatus main body.

As illustrated in FIG. 2A, the image forming apparatus 1 includes a front plate 642 formed of a metal plate and a rear plate 643 also formed of a metal plate. The front plate 642 is a sidewall provided on a near side of the image forming apparatus 1. At a portion on the near side of the main body of the image forming apparatus 1, the front plate 642 constitutes a portion of a housing of the apparatus main body. The rear plate 643 is a sidewall provided on a rear side of the image forming apparatus 1. At a portion on a far side of the main body of the image forming apparatus 1, the rear plate 643 constitutes a portion of the housing of the apparatus main body. As illustrated in FIG. 2A, the front plate 642 and the rear plate 643 are disposed so as to face each other. A metal plate (not shown) serving as a beam is bridged across the front plate 642 and the rear plate 643. The front plate 642, the rear plate 643, and the beam (not shown) constitute portions of the frame of the image forming apparatus 1. Note that the front surface side or the near side of the image forming apparatus 1 of the present embodiment or of the components thereof is a side on which the drum units 518 are moved in and out (inserted and removed) from the apparatus main body.

Openings are formed in the front plate 642 so that the drum units 518 and the developing units 641 can be inserted and removed from the near side of the image forming apparatus 1. The drum units 518 and the developing units 641 are mounted to predetermined positions (mount positions) in the main body of the image forming apparatus 1 through the openings. Furthermore, the image forming apparatus 1 includes covers 558Y, 558M, 558C, and 558K (hereinafter, also collectively referred to as merely "covers 558") that cover the near sides of both the drum units 518 and the developing units 641 mounted in the mount position. One end of the cover 558 is fixed to the main body of the image forming apparatus 1 with a hinge. The hinge allows the cover 558 to pivot relative to the main body of the image forming apparatus 1. The operator completes the replacing work by opening the cover 558 and taking out the drum unit 518 or the developing unit 641 in the main body, and by inserting a new drum unit 518 or a new developing unit 641 and closing the cover 558.

Figure 2B:
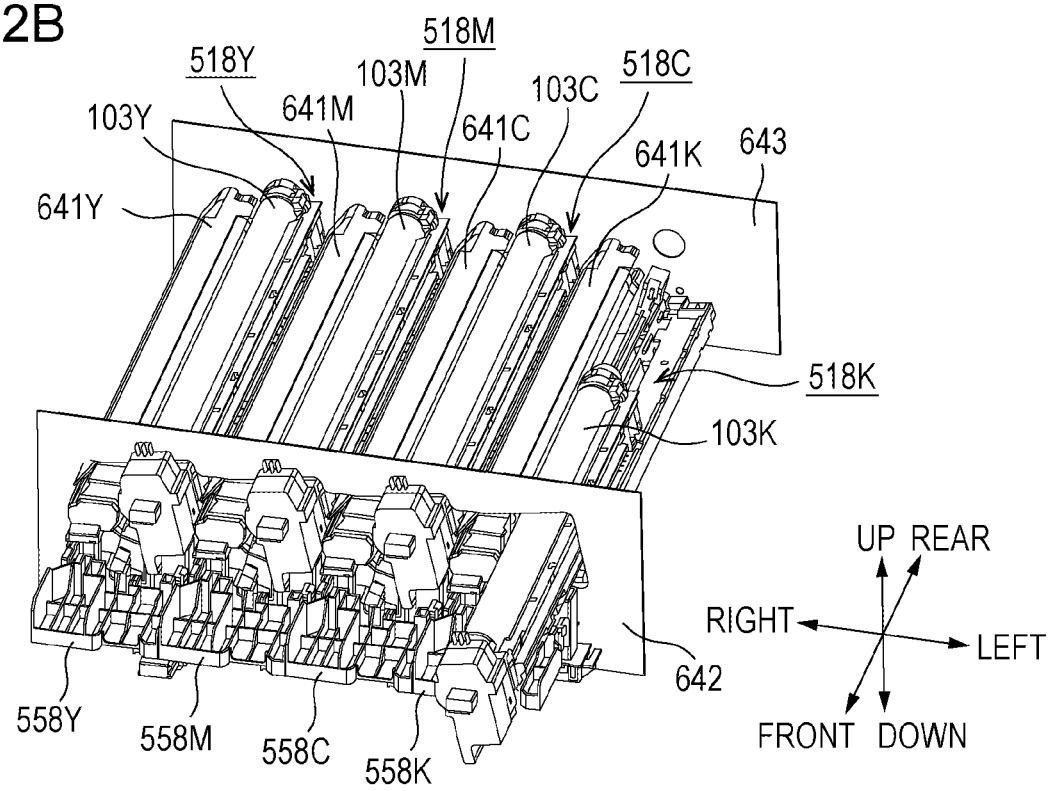

Note that in the following description, as illustrated in FIGS. 2A and 2B, the front plate 642 side of the apparatus main body is defined as a front side (the near side or the front surface side), and the rear plate 643 side is defined as the rear side (the far side or a back surface side). Furthermore, with reference to the photosensitive drum 103K on which an electrostatic latent image related to the black toner image is formed, a side on which the photosensitive drum 103Y (on which an electrostatic latent image related to the yellow toner image is formed) is situated is defined as the left side. With reference to the photosensitive drum 103Y on which the electrostatic latent image related to the yellow toner image is formed, a side on which the photosensitive drum 103K (on which the electrostatic latent image related to the black toner image is formed) is situated is defined as the right side. Furthermore, a direction that is perpendicular to the front-rear direction and the left-right direction described herein and that is a vertically upward direction is defined as an up direction, and a direction that is perpendicular to the front-rear direction and the left-right direction described herein and that is a vertically downward direction is defined as a down direction. The front direction, the rear direction, the right direction, the left direction, the up direction, and the down direction that have been defined are illustrated in FIGS. 2A and 2B. Furthermore, a rotational axis direction of the photosensitive drum 103 described in the text hereinafter is a direction that coincides with the front-rear direction illustrated in FIGS. 2A and 2B. Furthermore, a longitudinal direction of an optical print head 105 is also a direction that coincides with the front-rear direction illustrated in FIGS. 2A and 2B. In other words, the rotational axis direction of the photosensitive drum 103 and the longitudinal direction of the optical print head 105 are directions coinciding each other.

Exposure Unit

A description of the exposure unit 520 including the optical print head 105 will be given next. The optical print head 105 has a longitudinal shape that extends in the rotational axis direction of the photosensitive drum 103. Furthermore, the optical print head 105 includes a holding body 505, a lens array 506, and a substrate (not shown). The lens array 506 and the substrate (not shown) are supported by the holding body 505. The holding body 505 is a metal member formed by bending a galvanized steel plate or a cold rolled steel plate on which plating has been performed, for example. Furthermore, the holding body 505 is a magnetic body that becomes magnetized when placed in a magnetic field. Note that as an example of an exposure method employed in the image forming apparatus that uses an electrophotographic method, there is a laser beam scan exposure method that exposes a photosensitive drum through an f-O lens by having an irradiation beam of a semiconductor laser perform scanning with a rotating polygon mirror. The optical print head 105 described in the present embodiment is used in an LED exposure method that exposes the photosensitive drum 103 using a light emitting element, such as LEDs and the like arranged in the rotational axis direction of the photosensitive drum 103, and is not used in the laser beam scan exposure method described above.

Figure 3:
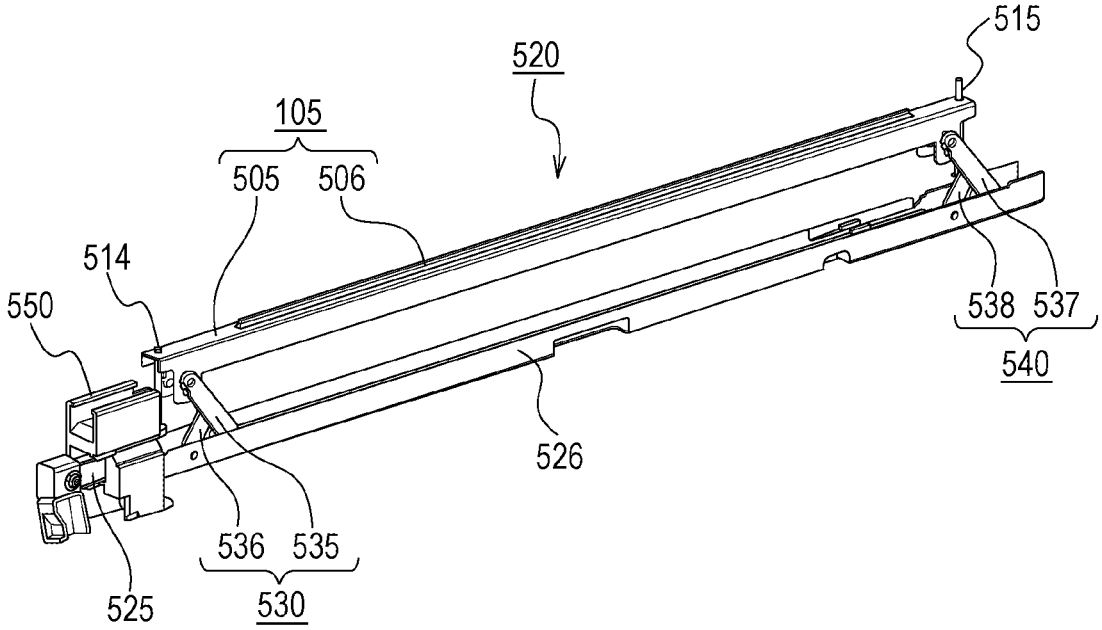
FIG. 3 is a schematic perspective view of an exposure unit.

The exposure unit 520 described in the present embodiment is provided vertically below the rotational axis of the photosensitive drum 103. LEDs serving as a light emitting element are provided in the substrate (not shown) included in the holding body 505. The light emitting element exposes the photosensitive drum 103 from below. Note that the exposure unit 520 may be provided vertically above the rotational axis of the photosensitive drum 103 and the photosensitive drum 103 may be exposed from above (see FIG. 1B). FIG. 3 is a schematic perspective view of the exposure unit 520 included in the image forming apparatus 1 of the present embodiment.

Referring to FIG. 3, the exposure unit 520 includes the optical print head 105, a support member 526, a first link mechanism 530, and a second link mechanism 540.

As illustrated in FIG. 3, an abutting pin 514 and an abutting pin 515 are provided on the holding body 505 of the optical print head 105. A gap is formed between a light emission surface of the lens array 506 and the photosensitive drum 103 with the abutting pin 514 and the abutting pin 515 abutting against the drum unit 518. The position of the optical print head 105 with respect to the photosensitive drum 103 is set in the above manner. In the present embodiment, the abutting pin 514 and the abutting pin 515 are both straight pins formed of metal. Furthermore, the abutting pin 514 and the abutting pin 515 are fixed to the metal holding body 505 by welding. As described above, in the present embodiment, the abutting pin 514 and the abutting pin 515 are integral with the holding body 505. Note that fixing of the abutting pin 514 and abutting pin 515 to the holding body 505 is not limited to welding and may be performed by an adhesive agent. Furthermore, screw threads may be cut on the abutting pin 514 and the abutting pin 515 and the abutting pin 514 and the abutting pin 515 may be fastened to the holding body 505 by screwing.

The first link mechanism 530 includes a link member 535 and a link member 536. The second link mechanism 540 includes a link member 537 and a link member 538. With the opening/closing operation of the cover 558 provided on the near side of the image forming apparatus 1, a slide member 525 described later slides and moves in the front-rear direction. Interlocking with the slide motion of the slide member 525, the link members 535 to 538 pivot and the optical print head 105 moves vertically.

In the present embodiment, the optical print head 105 is provided vertically below the photosensitive drum 103. In other words, in the image forming apparatus 1 according to the present embodiment, the optical print heads 105 expose the photosensitive drums 103 from below in the vertical direction.

Furthermore, as illustrated in FIG. 3, the exposure unit 520 includes the support member 526. The support member 526 supports the optical print head 105 through the first link mechanism 530 and the second link mechanism 540. Specifically, the link member 535 of the first link mechanism 530 supports the holding body 505, and the link member 537 of the second link mechanism 540 supports the holding body 505. The support member 526 is formed by bending a metal plate into a U-shape. The support member 526 is a member having a longitudinal shape that extends in the rotational axis direction of the photosensitive drum 103. A first end side (the near side) of the support member 526 in the longitudinal direction of the support member 526 is fixed to the front plate 642, and a second end side (the far side) of the support member 526 in the longitudinal direction of the support member 526 is fixed to the rear plate 643. The support member 526 is fixed to the apparatus main body of the image forming apparatus 1 in the above manner.

The support member 526 includes the slide member 525 that is movable in the longitudinal direction of the support member 526. With the movement of the slide member 525 relative to the support member 526, the link members 535 to 538 are pivoted and the optical print head 105 is moved relative to the support member 526.

Figure 4A:
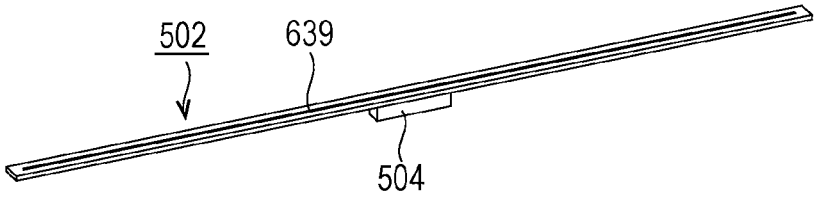
Figure 4A:
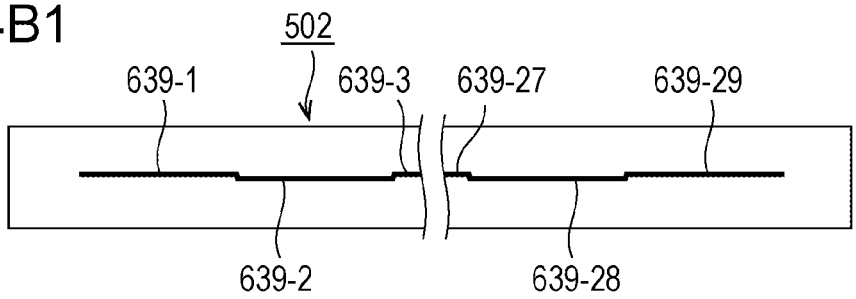
Figure 4A:
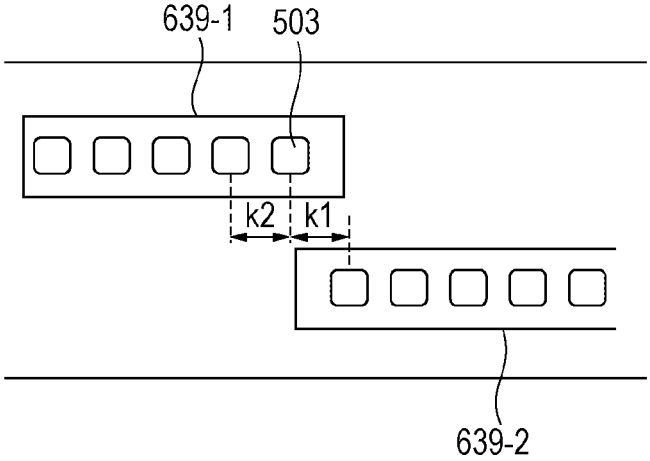
Figure 4A:
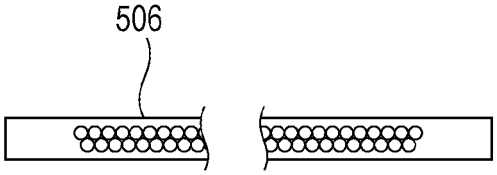
Figure 4A:
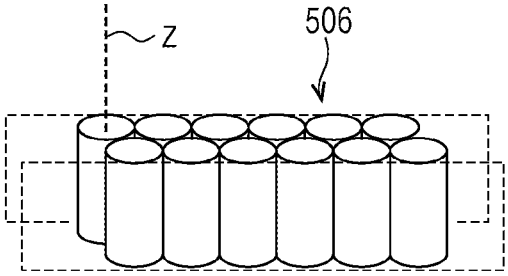

Furthermore, an insertion portion 550 into which a cleaning member 600 described later is inserted is fixed to the support member 526. Since the support member 526 is fixed to the apparatus main body of the image forming apparatus 1, the insertion portion 550 is also fixed to the apparatus main body of the image forming apparatus 1. Referring to FIGS. 4A to 4C2, a description of a substrate 502 and the lens array 506 that the holding body 505 of the optical print head 105 holds will be given. A description of the substrate 502 will be given first. FIG. 4A is a schematic perspective view of the substrate 502. FIG. 4B1 illustrates an arrangement of a plurality of LEDs 503 provided on the substrate 502, and FIG. 4B2 illustrates an enlarged view of FIG. 4B1.

LED chips 639 are mounted on the substrate 502. As illustrated in FIG. 4A, the LED chips 639 are provided on one side of the substrate 502, and a connector 504 is provided on a back surface side of the substrate 502. The substrate 502 is provided with wiring that supplies a signal to each of the LED chips 639. One end of a flexible flat cable or FFC (not shown) is coupled to the connector 504. The main body of the image forming apparatus 1 is provided with a substrate. The substrate includes a control unit and a connector. The other end of the FFC is coupled to the above connector that is provided on the substrate of the main body of the image forming apparatus. Control signals are input to the substrate 502 from the control unit in the main body of the image forming apparatus 1 through the FFC and the connector 504. The LED chips 639 are driven by the control signals input to the substrate 502.

The LED chips 639 mounted on the substrate 502 will be described later in further detail. As illustrated in FIGS. 4B1 and 4B2, a plurality of LED chips 639-1 to 639-29 (29 chips) in which a plurality of LEDs 503 are disposed are arranged on one side of the substrate 502. In each of the LED chips 639-1 to 639-29, 516 LEDs (light emitting elements) are arranged in one line in the longitudinal direction of the LED chips 639-1 to 639-29. A center-to-center dimension k2 of the adjacent LEDs in the longitudinal direction of the LED chips 639 corresponds to the resolution of the image forming apparatus 1. Since the resolution of the image forming apparatus 1 of the present embodiment is 1200 dpi, the LEDs of the LED chips 639-1 to 639-29 are arranged in one line so that the center-to-center dimensions of adjacent LEDs in the longitudinal direction of the LED chips 639 are 21.16 μm. Accordingly, an exposure area of the optical print head 105 of the present embodiment is about 316 mm. A photoconductive layer of the photosensitive drum 103 is formed with a width of 316 mm or more. Since a length of a long side of a sheet of A4-sized recording paper and a length of a short side of a sheet of A3-size recording paper are 297 mm, the optical print head 105 of the present embodiment has the exposure area that allows an image to be formed on A4-size recording paper and A3-size recording paper.

The LED chips 639-1 to 639-29 are disposed alternately in two rows and in the rotational axis direction of the photosensitive drum 103. In other words, as illustrated in FIG. 4B1, the odd-numbered LED chips 639-1, 639-3, . . . 639-29 when counted from the left side are mounted in a single row in the longitudinal direction of the substrate 502, and the even-numbered LED chips 639-2, 639-4, . . . 639-28 are mounted in a single row in the longitudinal direction of the substrate 502. By disposing the LED chips 639 in the above manner, as illustrated in FIG. 4B2, a center-to-center dimension k1 between one end of an LED chip 639 and the other end of an LED chip 639 that are separate LED chips 639 disposed adjacent to each other in the longitudinal direction of the LED chips 639 can be made the same as the center-to-center dimension k2 between adjacent LEDs in a single LED chip 639.

Note that in the present embodiment, while the light emitting elements are semiconductor LEDs that are light emitting diodes, the light emitting elements may be organic light emitting diodes (OLEDs), for example. The OLEDs are also called organic electroluminescences and are current-driven light emitting elements. The OLEDs are disposed on a thin film transistor (TFT) substrate and along a line extending in a main scanning direction (in a rotational axis direction of the photosensitive drum 103), for example, and are electrically coupled in parallel with power supply wiring that is also provided in the main scanning direction.

A description of the lens array 506 will be given next. FIG. 4C1 is a schematic view of the lens array 506 viewed from the photosensitive drum 103 side. Furthermore, FIG. 4C2 is a schematic perspective view of the lens array 506. As illustrated in FIG. 4C1, the plurality of lenses are aligned in two lines and in a direction in which the plurality of LEDs 503 are arranged. The lenses are disposed alternately so that each lens of one line is in contact with two lenses of the other line that are adjacent to each other in the direction in which the lenses are arranged. Each lens is a columnar rod lens formed of glass, and includes an incoming surface into which the light emitted from the LED 503 enters and an outgoing surface through which the light incident on the incoming surface exits. Note that the material of the lens is not limited to glass and may be another material such as plastic. The shape of the lens is not limited to a columnar shape and may be a polygonal prism such as, for example, a hexagonal cylinder.

A broken line Z illustrated in FIG. 4C2 depicts an optical axis of the lens. The optical print head 105 is moved by a moving mechanism 640 substantially in the direction of the optical axis of the lens depicted by the broken line Z. The optical axis of the lens herein denotes a line that connects the center of the light emission surface of the lens and the focal point of the lens. The lens array 506 has a role of collecting the light emitted through the LEDs 503 to the surface of the photosensitive drum 103.

Figure 5:
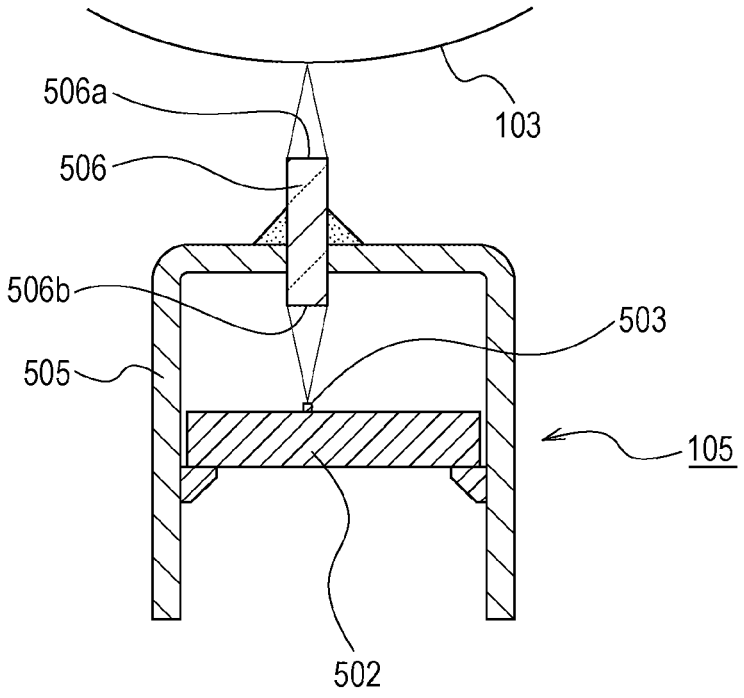
FIG. 5 is a diagram illustrating a positional relationship between the substrate and the lens array, and a positional relationship between the lens array and the photosensitive drum.

FIG. 5 is a cross-sectional view of the optical print head 105 cut perpendicular to the longitudinal direction of the optical print head 105. As illustrated in FIG. 5, the substrate 502 and the lens array 506 are held by the holding body 505 so as to oppose each other. The holding body 505 is a plate such as a galvanized steel plate or a cold rolled steel plate on which plating has been performed. In the present embodiment, the holding body 505 is formed by bending a plate into a U-shape. By using a metal plate, the cost can be suppressed, and by performing bending, strength can be obtained.

However, the holding body 505 is not limited to being configured of a bent metal plate and can be configured by so-called die-cast, for example. Die-cast is a product produced by cooling and solidifying molten metal injected into a mold (a cavity) or a manufacturing method of the product. When die-cast is adopted as the manufacturing method, complex shapes can be dealt with depending on the mold that is the basis of the shape. On the other hand, since fabricating the mold is costly, there is a disadvantage in that there is no cost advantage when there is no need to manufacture a large amount of the same product. In the present embodiment, the holding body 505 may be manufactured by bending a metal plate or may be manufactured by adopting die-cast.

The lens array 506 forms the light flux that has exited the LEDs 503 into an unmagnified erect image on the photosensitive drum 103. In so doing, a distance between the luminescence point of the LED and the light incoming surface 506*b* of the lens array 506 and a distance between the light emission surface 506*a* of the lens array 506 and the surface of the photosensitive drum 103 are substantially the same.

Moving Mechanism

Figure 6A:
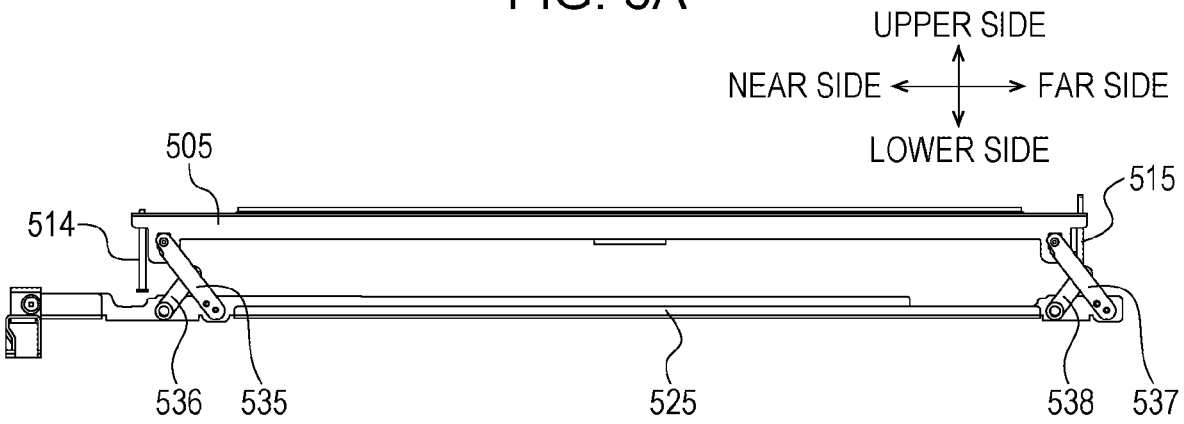
FIGS. 6A and 6B are diagrams illustrating a manner in which the optical print head moves to an exposing position and to a retracted position.
Figure 6B:
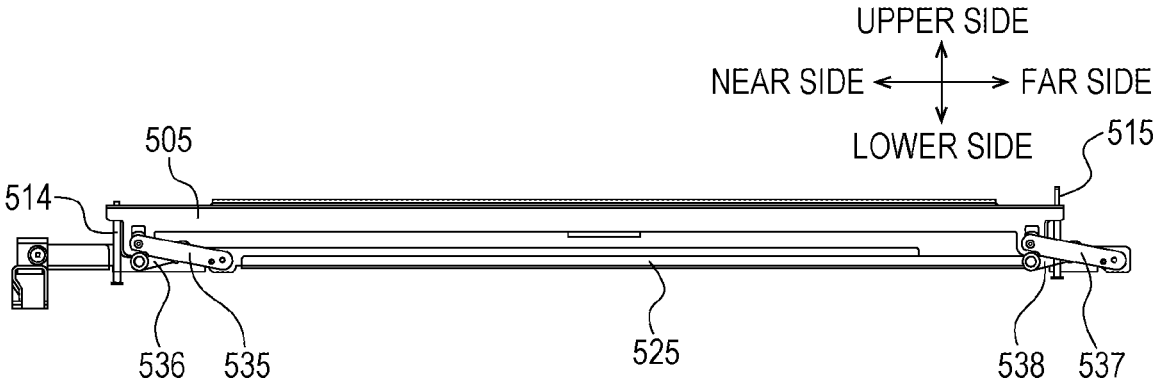

Referring next to FIGS. 6A and 6B, a mechanism in which the optical print head 105 interlocking with the slide motion of the slide member 525 moves will be described. FIGS. 6A and 6B are diagrams of the exposure unit 520 viewed from the right side. In order to simplify the description, the support member 526 is not illustrated. Note that FIG. 6A illustrates a state in which the optical print head 105 is positioned at an exposing position that is a position where the optical print head 105 exposes the photosensitive drum 103. On the other hand, FIG. 6B illustrates a state in which the optical print head 105 is positioned at a retracted position in which the optical print head 105 has retracted from the photosensitive drum 103 with respect to the exposing position. Note that in the present embodiment, the distance between the photosensitive drum 103 and the light emission surface of the lens array 506 when the optical print head 105 is positioned at the exposing position is about 3 mm.

As illustrated in FIGS. 6A and 6B, the link member 535 is pivotably coupled to a first end side of the slide member 525 in the longitudinal direction of the slide member 525, and the link member 537 is pivotably coupled to a second end side of the slide member 525 in the longitudinal direction of the slide member 525. As the cover 558 (not shown) is pivoted from the closed state to the open state, the slide member 525 is slid and moved from the near side to the far side. When the slide member 525 is slid and moved from the near side to the far side, the link member 535 and the link member 537 are pivoted counterclockwise in FIGS. 6A and 6B. Furthermore, the link member 535 and the link member 536 are pivotably coupled to each other. The link member 537 and the link member 538 are pivotably coupled to each other as well.

Since a first end of the link member 536 is pivotably coupled to the support member 526 (not shown), the link member 536 interlocking with the pivoting of the link member 535 is also pivoted relative to the support member 526. Furthermore, since a first end of the link member 538 is pivotably coupled to the support member 526 (not shown), the link member 538 interlocking with the pivoting of the link member 537 is also pivoted relative to the support member 526. When the slide member 525 moves from the near side towards the far side, the link member 536 and the link member 538 both pivot clockwise relative to the support member 526. Note that a second end side of the link member 535 is pivotably coupled to the holding body 505, and a second end side of the link member 537 is pivotably coupled to the holding body 505. Accordingly, by having the link member 535 and the link member 537 interlocked with the slide motion of the slide member 525 from the near side towards the far side pivot counterclockwise, the second end side of the link member 535 and the second end side of the link member 537 each move in a direction away from the photosensitive drum 103. The optical print head 105 moves from the exposing position towards the retracted position in the above manner.

A manner in which the optical print head 105 interlocked with the slide motion of the slide member 525 moves from the state illustrated in FIG. 6B to the state illustrated in FIG. 6A, in other words, a manner in which the optical print head 105 moves from the retracted position towards the exposing position, will be described next.

The slide member 525 interlocked with the pivoting of the cover 558 from the open state to the closed state moves from the far side towards the near side. When the slide member is slid and moved from the far side towards the near side, the link member 535 and the link member 537 are pivoted clockwise in FIGS. 6A and 6B. Concurrently, the link member 536 and the link member 538 pivot counterclockwise. By having the link member 535 and the link member 537 interlocked with the slide motion of the slide member 525 from the far side towards the near side pivot clockwise, the second end side of the link member 535 and the second end side of the link member 537 each move in a direction approaching the photosensitive drum 103. The optical print head 105 moves from the retracted position towards the exposing position in the above manner. Note that in the present embodiment, the direction in which the optical print head 105 moves between the retracted position and the exposing position substantially coincides with the optical axis direction of the lens array 506.

When the holding body 505 of the optical print head 105 interlocking with the slide motion of the slide member 525 moves from the retracted position towards the exposing position, the abutting pin 514 provided on a first end side of the holding body 505 in the longitudinal direction of the holding body 505, and the abutting pin 515 provided on a second end side of the holding body 505 abuts against the drum unit 518. The position of the holding body 505 with respect to the drum unit 518, in other words, the position of the optical print head 105, is set in the above manner.

When the position of the holding body 505 with respect to the drum unit 518 is set in the above manner, the distance between the photosensitive drum 103 and the light emission surface of the lens array 506 is set as well and the moving of the optical print head 105 to the exposing position is completed.

Figure 7A:
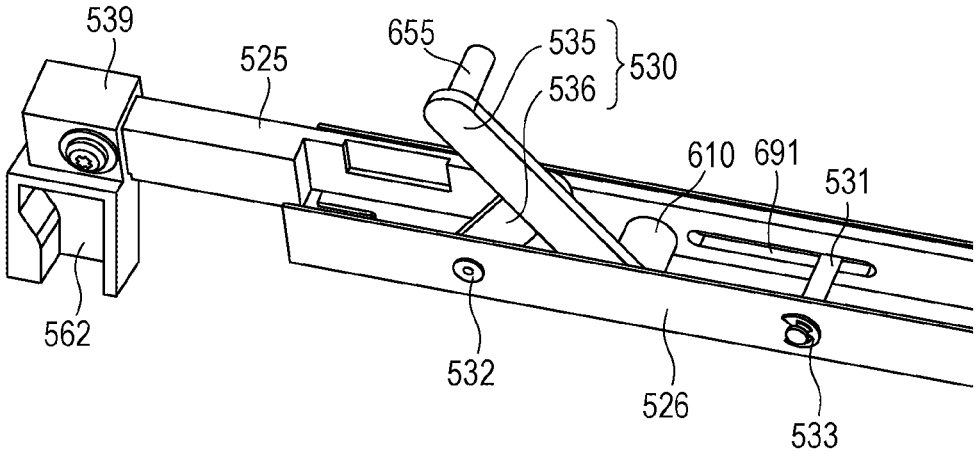
FIGS. 7A and 7B are diagrams illustrating a link mechanism that is an example of a moving mechanism.
Figure 7B:
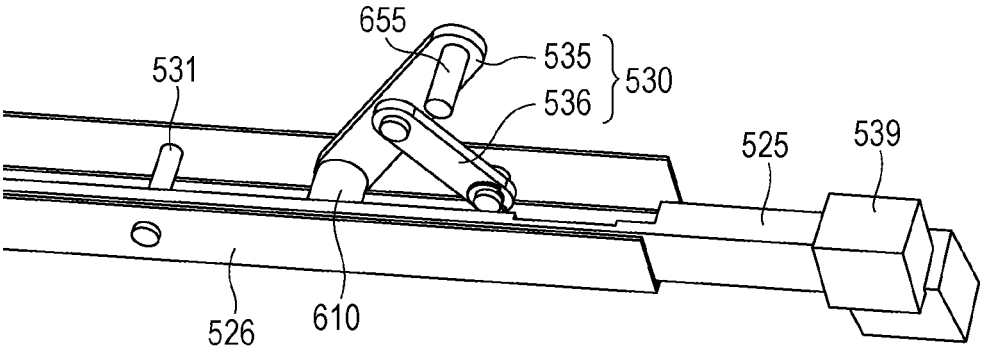

Referring to FIGS. 7A, 7B, 8A, and 8B, mechanisms of the link mechanism 530 and the link mechanism 540 will be described in further detail. FIG. 7A is a schematic perspective view of the front side of the support member 526 viewed from the right side. Furthermore, FIG. 7B is a schematic perspective view of the front side of the support member 526 viewed from the left side. The link mechanism 530 provided on the near side of the support member 526 will be described below. Since the configuration of the link mechanism 540 is substantially the same as the configuration of the link mechanism 530, the description thereof is omitted.

As illustrated in FIGS. 7A and 7B, the support member 526 includes a support shaft 531 and an E-type retaining ring 533. A hole through which the support shaft 531 is inserted is provided in a right lateral wall surface and in a left lateral wall surface of the support member 526 which is processed in a U-shape. In a state in which the support shaft 531 is inserted through the holes, the support shaft 531 is fixed to the support member 526 with the E-type retaining ring 533.

The slide member 525 is a metal plate member. As illustrated in FIG. 7A, a long hole 691 extending in the front-rear direction is formed in the slide member 525. The support shaft 531 is inserted through the long hole 691. In the present embodiment, the support shaft 531 is loosely fitted into the long hole 691 so that there is a gap of about 0.1 to 0.5 mm in the up-down direction. Furthermore, the diameter of the long hole 691 in the longitudinal direction is about 350 mm. With the above, the slide member 525 can, relative to the support member 526, slide and move for about 350 mm in the front-rear direction.

Furthermore, an auxiliary member 539 is attached to a first end side of the slide member (the near side of the slide member 525) in the longitudinal direction of the slide member 525. An accommodation space 562 is formed in the auxiliary member 539. A protrusion provided on the cover 558 is accommodated in the accommodation space 562. When the cover 558 pivots, the protrusion moving together with the pivoting cover 558 abuts against a sidewall of the accommodation space 562 on the near side or a sidewall thereof on the far side. By having the protrusion push the sidewall of the accommodation space 562 on the near side, the slide member 525 is moved to the near side. On the other hand, by having the protrusion push the sidewall of the accommodation space 562 on the far side, the slide member 525 is moved to the far side. As described above, the slide member 525 interlocked with the pivoting of the cover 558 also moves in the front-rear direction.

The link mechanism 530 includes the link member 535 and the link member 536. The link member 535 and the link member 536 are each a longitudinal plate. In the present embodiment, the link member 535 and the link member 536 are resin molded. A protrusion 655 is formed on a first end side (the upper side in FIG. 7A) of the link member 535 in the longitudinal direction of the link member 535. On the other hand, a cylindrical portion 610 is formed on the second end side (the lower side in FIG. 7A) of the link member 535 in the longitudinal direction of the link member 535. The protrusion 655 is fitted in an opening formed on the near side of the holding body 505. With the above, the link member 536 can, relative to the holding body 505, pivot about the protrusion 655 serving as a rotation center. The cylindrical portion 610 is a hollow circular cylinder. In FIGS. 7A and 7B, a protrusion 534 (shown in FIGS. 8A and 8B) protruding from the slide member 525 is fitted in the cylindrical portion 610. With the above, the link member 536 can pivot with respect to the slide member 525.

The first end side (the upper side in FIG. 7B) of the link member 536 in the longitudinal direction is pivotably attached to the link member 535. In other words, the link member 535 and the link member 536 are pivotable to each other. On the other hand, a second end side (the lower side in FIG. 7B) of the link member 536 in the longitudinal direction of the link member 536 is pivotably attached to the support member 526. Specifically, a hole is formed on a lower side of the link member 536 and in the left lateral wall surface of the support member 526, and an insertion pin 532 is inserted through the holes. The link member 536 is pivotably fixed to the support member 526 in the above manner.

Figure 8A:
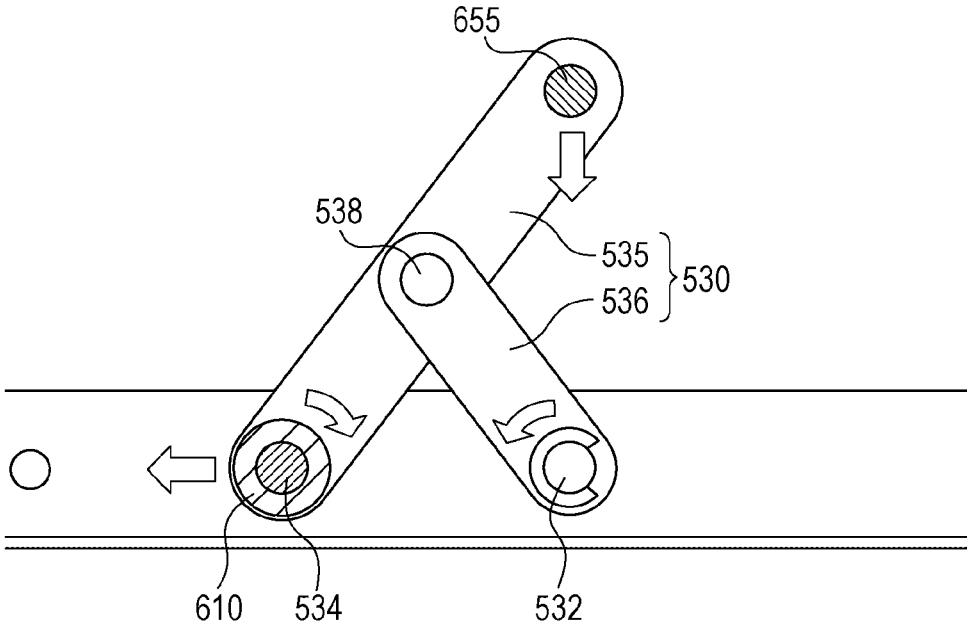
FIGS. 8A and 8B are diagrams illustrating a mechanism in which a first link member and a second link member pivot.
Figure 8B:
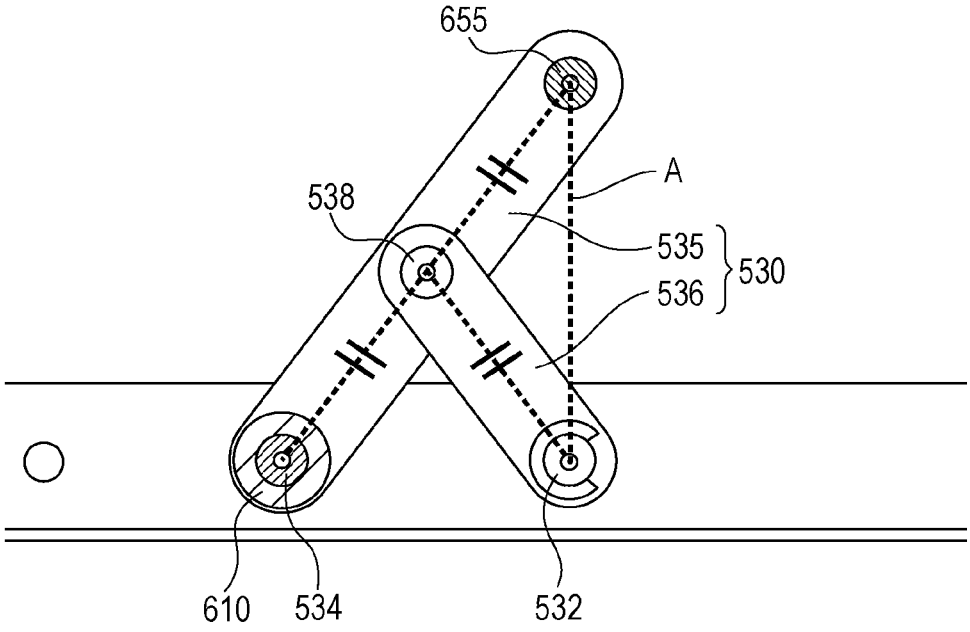

FIGS. 8A and 8B are diagrams illustrating a manner in which the link member 535 and the link member 536 included in the link mechanism 530 pivot. As described above, the cylindrical portion 610 formed on the link member 535 is fitted over the protrusion 534 formed on the slide member 525. Accordingly, when the slide member 525 is slid and moved from the near side towards the far side, the link member 535 pivots clockwise in FIGS. 8A and 8B about the protrusion 534. Since the link member 535 and the link member 536 are pivotably coupled to each other, the link member 536 interlocked with the clockwise pivoting of the link member 535 pivots counterclockwise relative to the slide member 525. In so doing, the link member 536, relative to the support member 526, pivots about the insertion pin 532. By having the link member 535 pivotably supported by the link member 536 pivot, the protrusion 655 of the link member 535 moves downwards.

Note that when L1 is a distance between a pivot axis of the link member 535 in the slide member 525 and an axis of the connection between the link member 535 and the link member 536, L2 is a distance between a pivot axis of the link member 536 in the support member 526 and the axis of the connection between the link member 535 and the link member 536, and L3 is a distance between the pivot axis of the link member 535 in the holding body 505 and the axis of the connection between the link member 535 and the link member 536, L1 to L3 are the same. Generally, such a link mechanism is also referred to as a Scott Russell mechanism. By having the distances L1 to L3 be the same, the direction in which the protrusion 655 interlocked with the slide motion of the slide member 525 moves becomes a perpendicular direction. Specifically, the protrusion 655 moves on a broken line A in FIG. 8B. With the above, the holding body 505 can be moved in the up-down direction while being interlocked with the slide motion of the slide member 525.

Figure 9A:
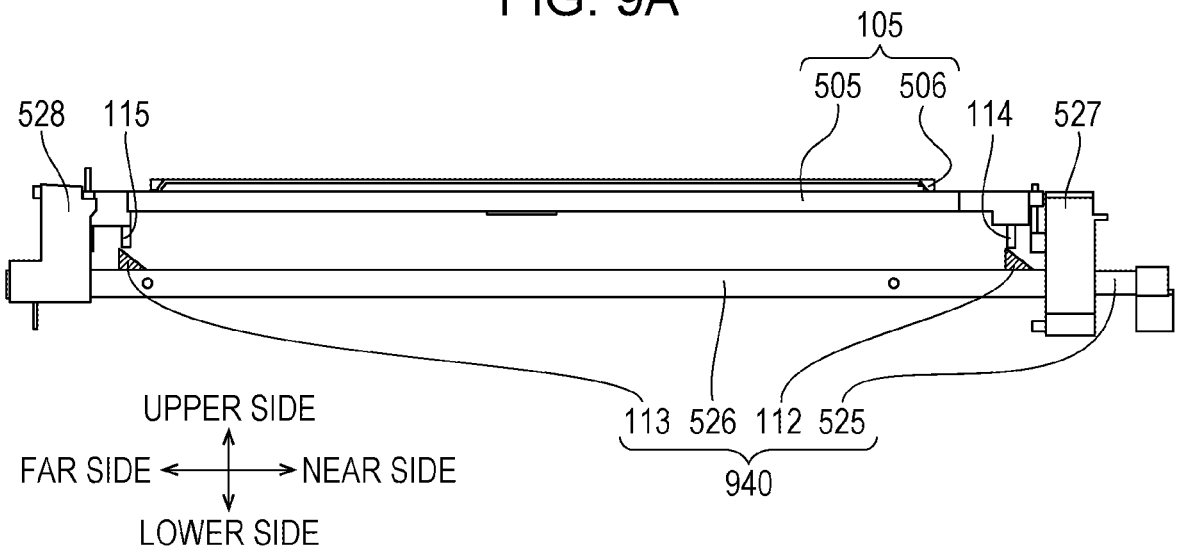
FIGS. 9A and 9B are diagrams illustrating a cam mechanism that is another example of the moving mechanism.
Figure 9B:
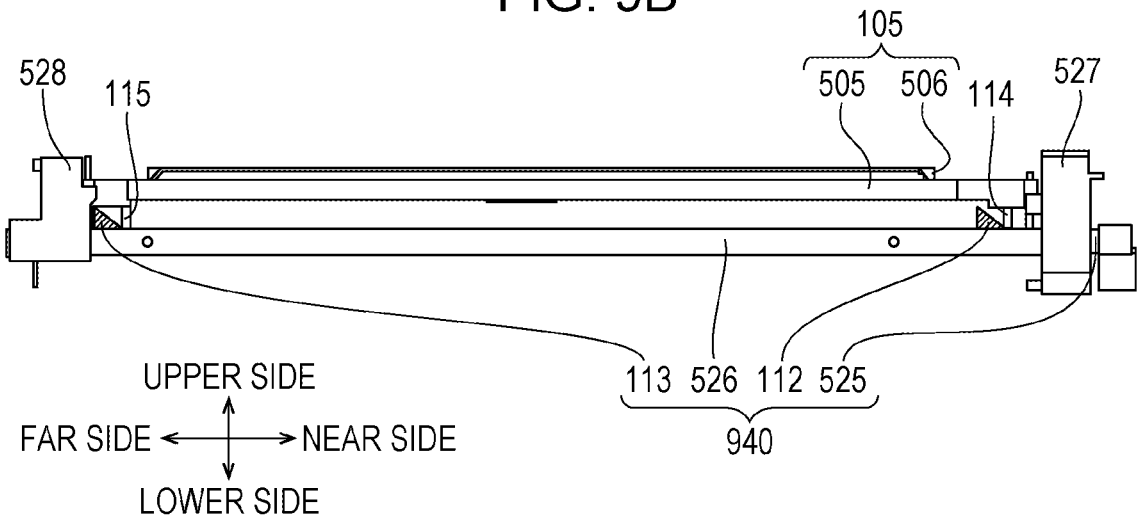

Furthermore, the configuration moving the optical print head 105 to the exposing position and to the retracted position is not limited to a configuration using the first link mechanism 530 and the second link mechanism 540 and may be a configuration using a moving mechanism 940 illustrated in FIGS. 9A and 9B. Referring hereinafter to FIGS. 9A and 9B, a description of the moving mechanism 940 will be given. Note that members having substantially the same functions as the members constituting the exposure units 520 will be attached with the same reference numerals and redundant descriptions thereof may be omitted.

As illustrated in FIGS. 9A and 9B, a first cam portion 112 and a second cam portion 113 are provided on the front side and the rear side of the slide member 525. Furthermore, a movement support portion 114 and a movement support portion 115 are provided on the near side and the far side of the holding body 505 included in the optical print head 105. The first cam portion 112 and the second cam portion 113 each include, on the holding body 505 side, an inclined surface inclined downwards from the rear side towards the front side.

FIG. 9A is a schematic view of the holding body 505 positioned at the exposing position and the moving mechanism 940 viewed from the right side. In a case in which the holding body 505 included in the optical print head 105 is positioned at the exposing position, when the slide member 525 slides and moves relative to the support member 526 from the front side to the rear side, the first cam portion 112 and the second cam portion 113 provided in the slide member 525 move relative to the support member 526 from the front side to the rear side together with the slide member 525. With the above, lower ends of the movement support portion 114 and the movement support portion 115 provided in the holding body 505 abut against the first cam portion 112 and the second cam portion 113, and the movement support portion 114 and the movement support portion 115 move along the first cam portion 112 and the second cam portion 113 in a direction extending from the exposing position towards the retracted position.

FIG. 9B is a schematic view of the holding body 505 positioned at the retracted position and the moving mechanism 940 viewed from the right side. In a case in which the holding body 505 included in the optical print head 105 is positioned at the retracted position, when the slide member 525 slides and moves relative to the support member 526 from the rear side to the front side, the first cam portion 112 and the second cam portion 113 provided in the slide member 525 slide and move relative to the support member 526 from the rear side to the front side together with the slide member 525. With the above, the lower ends of the movement support portion 114 and the movement support portion 115 provided in the holding body 505 are pushed up and moved along the first cam portion 112 and the second cam portion 113 in a direction extending from the retracted position towards the exposing position.

Cleaning Mechanism

In the image forming apparatus 1, each optical print head 105 is provided between the corresponding charger 104 and the corresponding developing device 106. Accordingly, there are cases in which the light emission surfaces of the lens arrays 506 become unclean due to the toner that has fallen off from the photosensitive drums 103 and the developing devices 106. Among the plurality of lenses included in each lens array 506, when a lens through which the light used in forming the image becomes unclean, the light emitted from the light emitting element becomes partially blocked. The above is one of the causes of a degradation in the image quality of the output image. Accordingly, it is desirable that the light emission surface of the lens array 506 included in the optical print head 105 is cleaned regularly.

Figure 10:
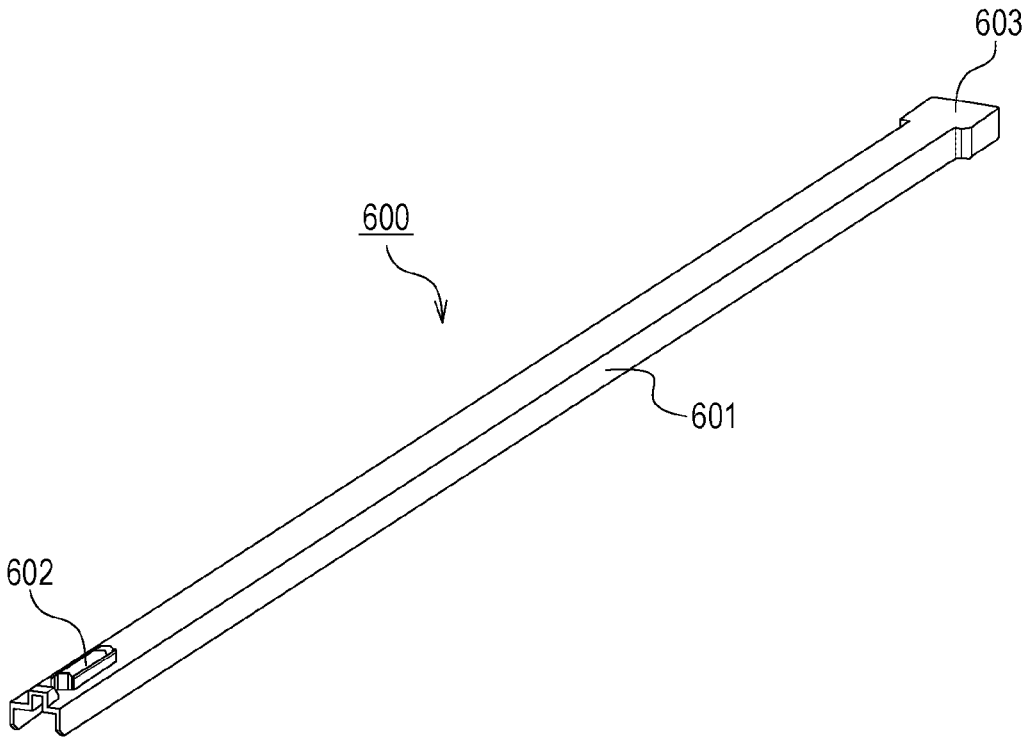
FIG. 10 is a perspective view of a cleaning member.

FIG. 10 is a schematic perspective view of the cleaning member 600 used in cleaning the light emission surface of the lens array 506. As illustrated in FIG. 10, the cleaning member 600 includes a rod 601, a magnet 602, and a grip portion 603. The rod 601 in the present embodiment is a longitudinal resin molding. When cut perpendicular to the longitudinal direction of the rod 601, the rod 601 has a U-shaped section. Furthermore, while a permanent magnet such as an alnico magnet, a ferrite magnet, or a neodymium magnet is used as the magnet 602, the type of magnet is not limited to such magnets, and the magnet 602 does not have to be a permanent magnet. The magnet 602 is provided on a first end side of the rod 601 in the longitudinal direction of the rod 601. While not illustrated in the drawing, a cleaning portion that rubs and cleans the light emission surface of the lens array 506 is provided on the first end side of the rod 601. Furthermore, the grip portion 603 that the operator grips onto is formed on a second end side of the rod 601 in the longitudinal direction of the rod 601. While the details will be described later, the light emission surface of the lens array 506 is cleaned by the operator, such as the user or the service man, holding the grip portion 603 and inserting and removing the cleaning member 600 into and from the apparatus main body.

The cleaning member 600 is attached to an inner side of a front cover provided on the near side of the image forming apparatus 1, for example. When there is a need to clean the light emission surface of the lens array 506, the operator, such as the user or the service man, removes the cleaning member 600 from the inner side of the front cover of the image forming apparatus 1. Subsequently, cleaning of the light emission surface of the lens array 506 is performed using the cleaning member 600. Note that the cleaning member 600 does not necessarily have to be attached to a portion of the image forming apparatus 1 and the service man may bring the cleaning member 600 each time cleaning is needed.

Note the front cover described herein is provided on the near side of the image forming apparatus 1 and is a door that is opened when the drum units 518 are replaced and when cleaning of the lens array 506 is performed using the cleaning member 600. When the drum unit 518 is replaced, the front cover is first opened and, furthermore, the cover 518 is opened. The cover 518 may be configured so as to be opened and closed while being interlocked with the opening and closing of the front cover.

In the present embodiment, the cleaning member 600 is installed on the inner side of the front cover. When the operator, such as the user or the service man, cleans the lens array 506, the cleaning member 600 is removed from the inner side of the front cover. Naturally, not limited to a configuration in which the cleaning member 600 is provided on the front cover, the cleaning member 600 may be installed in another portion of the image forming apparatus 1. Furthermore, the cleaning member 600 itself may not be installed in the image forming apparatus 1 and the service man may bring the cleaning member 600 when cleaning the lens array 506.

Figure 11:
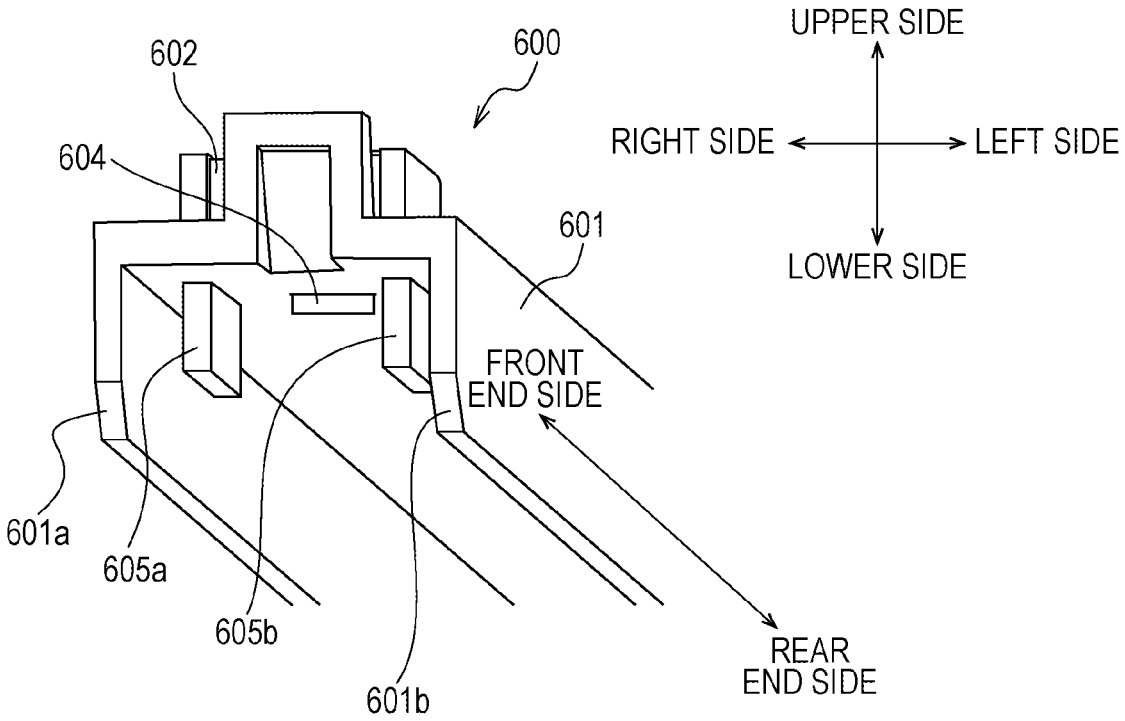
FIG. 11 is a diagram illustrating a cleaning portion provided in the cleaning member.

FIG. 11 is an enlarged perspective view of a first end side of the cleaning member 600 (hereinafter, merely referred to as a front end side of the cleaning member 600) in the longitudinal direction of the cleaning member 600, in other words, FIG. 11 is an enlarged perspective view of a front end side of the rod 601. In order to simplify the description, an upper side, a lower side, a right side, a left side, the front end side, and a rear end side are defined as those illustrated in FIG. 11.

As illustrated in FIG. 11, the magnet 602 is provided on the front end side of the rod 601 and on the upper side of the rod 601. Furthermore, a yoke 605*a* (a first yoke piece) and a yoke 605*b* (a second yoke piece) are provided on the front end side of the rod 601 so as to interpose the magnet 602 in between in the left-right direction. Note that the yoke 605*a* and the yoke 605*b* are magnetic metal plates and the material thereof is iron, for example. The yoke 605*a* and the yoke 605*b* are both in contact with the magnet 602 and are magnetized by the magnet 602. Note that the yoke 605*a* and the yoke 605*b* do not have to be separate members and may be provided in the cleaning member 600 as a single integrated yoke (a yoke member 605).

The yoke 605*a* and the yoke 605*b* each penetrate through an upper side of the rod 601 at the front end side of the rod 601. In other words, the yoke 605*a* is exposed from the rod 601 to both the upper side and the lower side. The yoke 605*b* is also exposed from the rod 601 to both the upper side and the lower side.

Note that the yoke 605*a* (605*b*) is also referred to as a heel piece, and has a feature of facilitating the magnetic flux from the magnet to pass therethrough. Generally, an index called magnetic permeability that serves as an index indicating the ease at which a magnetic flux passes through matter is known. When comparing the magnetic permeability of a magnetic material widely used as the yoke and the magnetic permeability of the atmosphere, the value of the magnetic permeability of the yoke is a few thousand when the magnetic permeability of the atmosphere is assumed as one. In view of the above, pure iron, low carbon steel, or ferrosilicon, for example, is used as the material of the yoke.

In FIG. 11, if the yoke 605*a* and the yoke 605*b* are not attached to the rod 601, the magnetic flux will leak into the atmosphere from the right lateral surface and the left lateral surface of the magnet 602. On the other hand, when the yoke 605*a* is attached so as to be in contact with the left side of the magnet 602, and the yoke 605*b* is attached so as to be in contact with the right side of the magnet 602, the magnetic flux emitted from the magnet 602 passes through the yoke 605*a* and the yoke 605*b* and leaks into the atmosphere from the lower side of the yoke 605*a* and the lower side of the yoke 605*b*. As described above, since the magnetic flux emitted by the magnet 602 is, without leaking into the atmosphere, concentrated to the yoke 605*a* and the yoke 605*b* that have high magnetic permeability, compared with when only the magnet 602 alone is used, attractive force between the front end side of the rod 601 and the holding body 505 can be increased when the yoke 605*a* and the yoke 605*b* are used. As described above, the orientation and the direction of the magnetic flux emitted from the magnet 602 can be controlled by using the yoke 605*a* and the yoke 605*b*.

In the present embodiment, the yoke 605*a* and the yoke 605*b* are provided in the rod 601 so as to, as an example, protrude, with respect to the magnet 602, on the side on which the holding body 505 is disposed. Specifically, in a state in which the cleaning member 600 is inserted in the insertion portion 550, the rod 601 is positioned between the magnet 602 and the holding body 505 in the optical axis direction of the lenses in the lens array 506. In such a configuration, the magnet 602 and the holding body 505 do not directly come in contact with each other.

Furthermore, a cleaning portion 604 is provided on the front end side of the rod 601. Since the cleaning portion 604 is fixed to the rod 601, the cleaning portion 604 moves together with the rod 601 that has been inserted into the insertion portion 550 and that is moved by the operator. In the present embodiment, the cleaning portion 604 is a flexible blade-shaped member formed of, for example, urethane rubber having a thickness of 0.5 mm. The cleaning portion 604 is provided on the front end side of the rod 601 so as to protrude downwards from the rod 601. In other words, a portion of the cleaning portion 604 is exposed to the lower side from the rod 601. Note that the cleaning portion 604 is not limited to the urethane rubber blade and may be a resin blade, a sponge, or nonwoven fabric, for example. In the present embodiment, the blade-shaped cleaning portion 604 protrudes about 3 mm from the lower side of the rod 601. While details will be described later, in a state in which the yoke 605*a* and the yoke 605*b* are in contact with the upper side of the holding body 505, about 0.5 mm of the lower side of the cleaning portion 604 is in contact with the light emission surface of the lens array 506.

As illustrated in FIG. 11, the cleaning portion 604 is located between the yoke 605*a* and the yoke 605*b*. While details will be described later, by being disposed in the above manner, the cleaning portion 604 and the light emission surface of the lens array 506 can reliably be made to be in contact with each other when the yoke 605*a* and the yoke 605*b* are in contact with the holding body 505. By moving the cleaning member 600 from the near side towards the far side of the image forming apparatus 1 while the cleaning portion 604 is in contact with the light emission surface of the lens array 506, the blade-shaped cleaning portion 604, while being flexed, rubs the light emission surface of the lens array 506. The toner and foreign substances such as dust accumulated on the light emission surface of the lens array 506 are scraped off by the cleaning portion 604 in the above manner.

Furthermore, an inclined surface 601*a* and an inclined surface 601*b* are formed on the front end side of the rod 601. The inclined surface 601*a* and the inclined surface 601*b* are inclined surfaces that are inclined upwards towards the front end side. As described above, by having the inclined surface 601*a* and the inclined surface 601*b* be formed on the front end side of the rod 601, the rod 601 can be inserted into the image forming apparatus 1 smoothly. The configuration in which the cleaning member 600 is inserted from the outside of the image forming apparatus 1 will be described in detail later.

Figure 12:
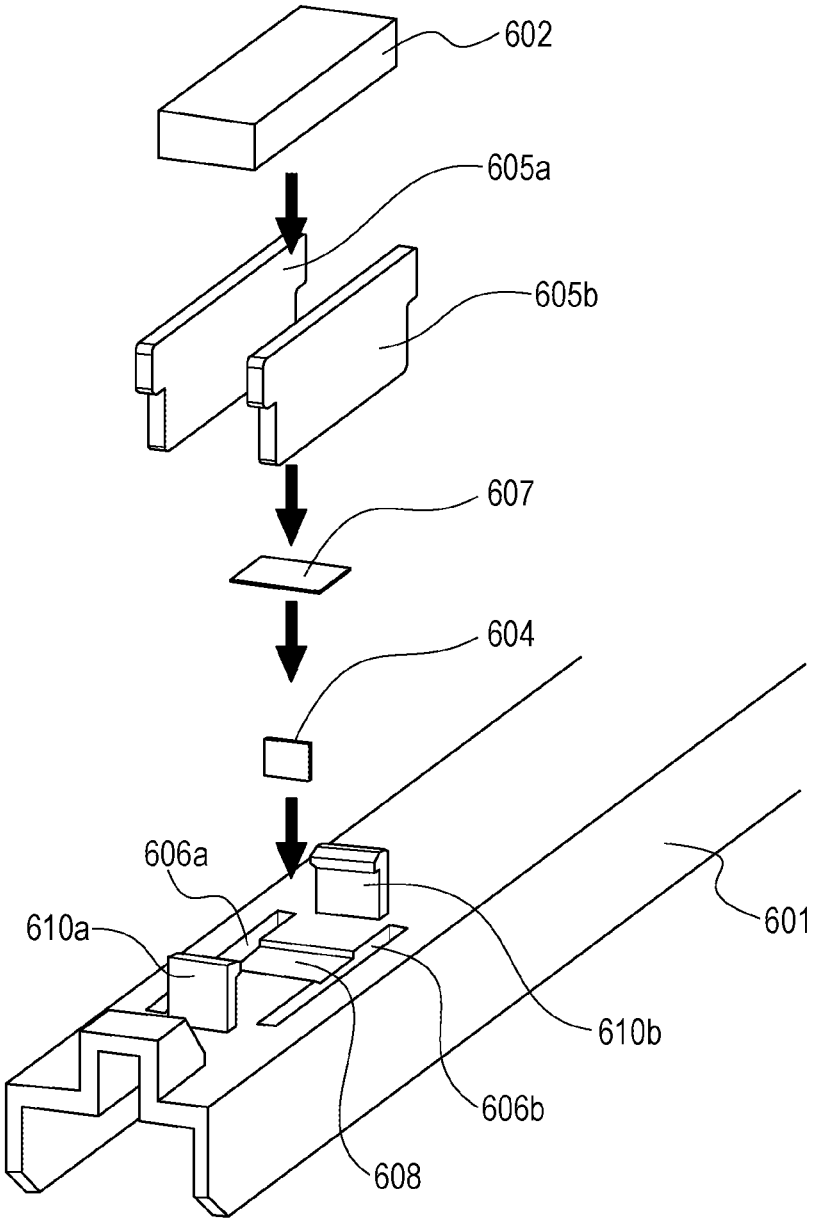
FIG. 12 is an exploded perspective view of the cleaning member.

Referring to FIG. 12, the configuration of the cleaning member 600 will be described in a further detailed manner. FIG. 12 is an exploded perspective view of the cleaning member 600. A hole 606*a* and a hole 606*b* are formed on the front end side of the rod 601 so as to interpose an attachment surface 608 therebetween. The hole 606*a* and the hole 606*b* are each a through hole that penetrates through an upper surface of the rod 601.

In the present embodiment, the cleaning portion 604 is a sheet-shaped blade formed of urethane rubber, and a portion thereof is exposed to the lower side of the rod 601 through a hole (not shown) formed on the front end side of the attachment surface 608. In a state in which the cleaning portion 604 is mounted on the attachment surface 608, a seal 607 is adhered to the cleaning portion 604 and the attachment surface 608. The seal 607 has adhesiveness on both sides.

As illustrated in FIG. 12, the yoke 605*a* and the yoke 605*b* are both T-shaped. Furthermore, a protruding portion of the T-shape, in other words, the protruding portion on the lower side of the yoke 605*a* (605*b*) in FIG. 12, protrudes into the lower side of the rod 601 through the hole 606*a* (the hole 606*b*).

The yoke 605*a* is inserted into the hole 606*a* formed on the front end side of the rod 601. Furthermore, the yoke 605*b* is inserted into the hole 606*b* formed on the front end side of the rod 601. The hole 606*a* is formed on the left side with respect to the attachment surface 608, and the hole 606*b* is formed on the right side with respect to the attachment surface 608. Accordingly, a portion of the yoke 605*a* inserted into the hole 606*a* protrudes, at a portion on the left side with respect to the cleaning portion 604, to the lower side from the rod 601. Furthermore, a portion of the yoke 605*b* inserted into the hole 606*b* protrudes, at a portion on the right side with respect to the cleaning portion 604, to the lower side from the rod 601. In other words, the yoke 605*a* and the yoke 605*b* protrude to the lower side from the rod 601 so as to interpose the cleaning portion 604 therebetween in the left-right direction. In other words, in a state in which the cleaning member 600 is inserted in the insertion portion 550, the yoke 605*a* and the yoke 605*b* protrude to the side on which the holding body 505 is disposed with respect to the magnet 602.

The magnet 602 is inserted between the yoke 605*a* and the yoke 605*b*. The magnet 602 is mounted on an upper surface of the seal 607 adhered to the attachment surface 608. The magnet 602 is fixed to the rod 601 in the above manner. An engagement protrusion 610*a* that opposes a front surface of the magnet 602 attached to the rod 601 is provided on the front end side of the rod 601. Similarly, an engagement protrusion 610*b* that opposes a rear surface of the magnet 602 attached to the rod 601 is also provided on the front end side of the rod 601. The engagement protrusion 610*a*, the engagement protrusion 610*b*, and the magnet 602 form a snap-fit structure. With the above, the magnet 602 attached to the front end side of the rod 601 is fixed to the rod 601 with the engagement protrusion 610*a* and the engagement protrusion 610*b*. Note that the fitting of the magnet 602 to the rod 601 is not limited to snap fitting and may be done by the adhesive power of the seal 607 alone or another adhesive agent may be applied.

The yoke 605*a* is in contact with a left lateral surface of the magnet 602, and the yoke 605*b* is in contact with the right lateral surface of the magnet 602. The yoke 605*a* and the yoke 605*b* become magnetized by being in contact with the magnet 602. By disposing the yoke 605*a* and the yoke 605*b* in the above manner, the magnetic flux leaking to the atmosphere from the front surface, the rear surface, the lower surface, and the upper surface of the magnet 602 can be reduced and the magnetic flux emitted by the magnet 602 can be concentrated to the yoke 605*a* and the yoke 605*b*.

The positional relationship between the yoke 605*a*, the yoke 605*b*, and the cleaning portion 604 will be described briefly next. A portion of the yoke 605*a* and a portion of the yoke 605*b* are, with respect to the cleaning portion 604, both positioned on the front end side of the rod 601 in the longitudinal direction of the rod 601. In other words, a portion of the yoke 605*a* and a portion of the yoke 605*b* are both located downstream of the cleaning portion 604 in a direction extending from the second end side (the rear end side) of the rod 601 in the longitudinal direction of the rod 601 towards the first end side (the front end side) of the rod 601 in the longitudinal direction of the rod 601. Furthermore, a portion of the magnet 602 as well is disposed so as to be located downstream of the cleaning portion 604 in the direction extending from the second end side (the rear end side) of the rod 601 in the longitudinal direction of the rod 601 towards the first end side (the front end side) of the rod 601 in the longitudinal direction of the rod 601. In other words, at least a portion of the magnet is disposed so as to be located nearer to the first end side than the cleaning portion. By having a portion of the yoke 605*a* and a portion of the yoke 605*b* be located on the front end side of the rod 601 with respect to the cleaning portion 604, the portion of the cleaning member 600 on the front end side with respect to the cleaning portion 604 is drawn to the holding body 505 by the attractive force created by the magnetic force; accordingly, the light emission surface of the lens array 506 can be cleaned sufficiently with the cleaning portion 604.

Figure 13:
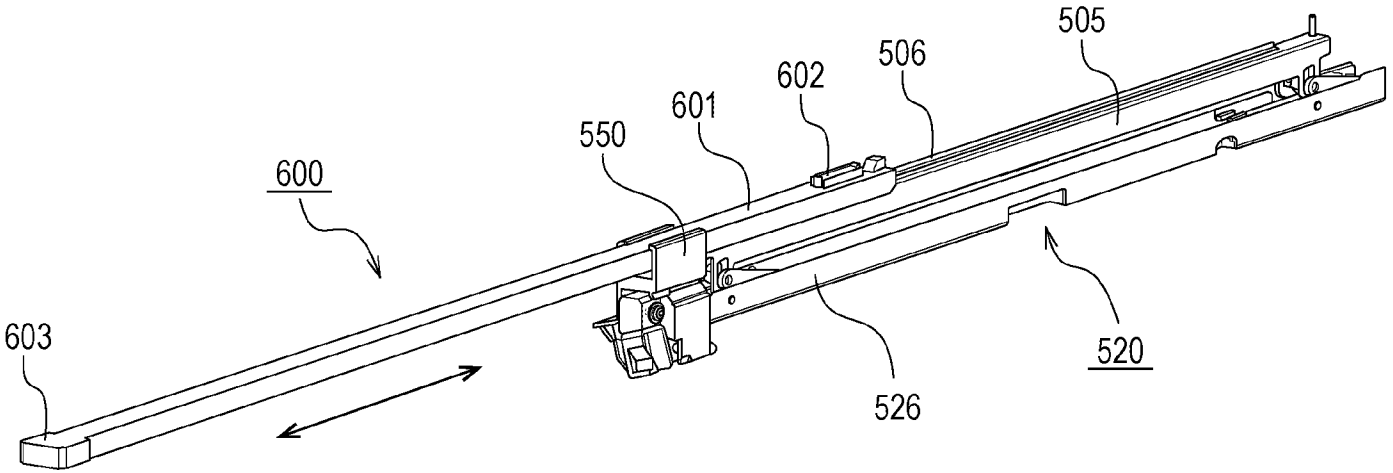
FIG. 13 is a diagram illustrating a manner in which a light emission surface of the lens array is cleaned using the cleaning member.

FIG. 13 is a diagram illustrating a state in which the cleaning member 600 is inserted into the apparatus main body of the image forming apparatus 1 from the outside. As illustrated in FIG. 13, the insertion portion 550 in which the cleaning member 600 has been inserted is provided integral with the support member 526 included in the exposure unit 520. Note that the support member 526 is fixed to the apparatus main body of the image forming apparatus 1. Accordingly, the insertion portion 550 is also fixed to the apparatus main body. The insertion portion 550 does not need to be provided in the support member 526 and, for example, may be formed in a member that is fixed to the apparatus main body or may be formed in the drum unit 518.

As illustrated in FIG. 13, in order to restrict the cleaning member 600 inserted in the insertion portion 550 from moving in the left-right direction, the insertion portion 550 includes walls that oppose the right lateral surface and the left lateral surface of the cleaning member 600 inserted in the insertion portion 600. An upper portion of each wall is bent in an L-shape so as to hold the cleaning member 600 within the walls. With the above, the cleaning member 600 inserted in the insertion portion 550 is restricted from moving in an upward direction away from the holding body 505. In other words, the cleaning member 600 inserted in the insertion portion 550 is restricted by the insertion portion 550 from moving in directions perpendicular to the direction (the direction of the arrow in FIG. 13) in which the cleaning member 600 is inserted into and removed from the insertion portion 550. In other words, the insertion portion 550 guides the movement of the cleaning member 600 in the direction depicted by the arrow in FIG. 13.

Note that in a state in which the cleaning member 600 is inserted in the insertion portion 550, there is a slight gap between the cleaning member 600 and the insertion portion 550. In the present embodiment, the gap between the cleaning member 600 inserted in the insertion portion 550 and the insertion portion 550 in the left-right direction is about 2 mm. Furthermore, in the up-down direction as well, there is a gap of about 2 mm between the cleaning member 600, which is inserted in the insertion portion 550 and is in contact with the bottom surface of the insertion portion 550, and an upper portion of the insertion portion 550. As described above, in a state in which the cleaning member 600 is inserted in the insertion portion 550, a slight gap is provided between the cleaning member 600 and the insertion portion 550. With the above, the operator can insert and remove the cleaning member 600 into and from the insertion portion 550 in a smooth manner.

However, in a state in which the cleaning member 600 is inserted in the insertion portion 550 and in which there is a slight gap between the cleaning member 600 and the insertion portion 550 in the up-down direction, when the operator applies a downward force to the grip portion 603, the front end side of the cleaning member 600 may move upwards with the insertion portion 550 of the cleaning member 600 as a fulcrum, and the cleaning portion 604 may become separated from the light emission surface of the lens array 506. In the above state, when the operator inserts and removes the cleaning member 600 into and from the insertion portion 550, the cleaning portion 604 may not rub the light emission surface of the lens array 506.

On the other hand, as the gap between the cleaning member 600 and the insertion portion 550 becomes smaller when the cleaning member 600 is inserted in the insertion portion 550, the operability when the cleaning member 600 is inserted into the insertion portion 550 from the outside of the apparatus main body becomes lower. Specifically, by obtaining a certain degree of clearance between the cleaning member 600 and the insertion portion 550 when the cleaning member 600 is inserted in the insertion portion 550, the operator will be able to easily insert the cleaning member 600 into the insertion portion 550.

Accordingly, in the present embodiment, the magnet 602 is provided on the front end side of the cleaning member 600. The magnet 602 and the holding body 505 try to draw each other towards each other with the magnetic force emitted by the magnet 602. Since the magnet 602 is provided in the rod 601, the front end side of the rod 601 also moves in a direction approaching the holding body 505. As described above, by creating attractive force between the magnet 602 and the holding body 505, the possibility of the front end side of the cleaning member 600 becoming separated from the holding body 505 in the up-down direction is reduced. While reducing the possibility of the cleaning portion 604 from becoming separated from the light emission surface of the lens array 506, the operability of the cleaning member 600 is maintained in the above manner.

The cleaning member 600 is inserted into and removed from the insertion portion 550 in the direction of the arrow by the operator. In the insertion direction of the cleaning member 600, the insertion portion 550 is provided upstream of the light emission surface of the lens array 506. When the operator inserts the cleaning member 600 into the insertion portion 550, the cleaning portion 604 (not shown) opposes the light emission surface of the lens array 506. In a state in which the cleaning portion 604 and the light emission surface of the lens array 506 oppose each other, attractive force, which is magnetic force, emitted by the magnet 602 acts on the yoke 605*a*, 605*b* provided on the front end side of the rod 601, and the holding body 505. In other words, force that draws the yoke 605*a*, 605*b* and the holding body 505 to each other acts on the yoke 605*a*, 605*b* and the holding body 505. In the above, since force oriented towards the holding body 505 also acts on the front end side of the rod 601 to which the yoke 605*a*, 605*b* is attached, the cleaning portion 604 and the light emission surface of the lens array 506 come in contact with each other. While maintaining the state in which the cleaning portion 604 and the light emission surface of the lens array 506 are in contact with each other, by inserting and removing the cleaning member 600 in the direction of the arrow, the cleaning portion 604 rubs and cleans the light emission surface of the lens array 506.

The size of the attractive force between the front end side of the rod 601 and the holding body 505 is desirably a size that maintains the state in which the cleaning portion 604 and the lens array 506 are in contact with each other when the operator pushes the grip portion 603 of the cleaning member 600 inserted in the insertion portion 550 downwards. In the present embodiment, the attractive force in the up-down direction (the optical axis direction of the lens array 506) that acts on the front end side of the rod 601 and the holding body 505 is about 100 gf. While the above value changes depending on the flexibility of the material of the rod 601, when the rod 601 is resin molded, attractive force of about 100 gf is needed.

Note that when cleaning the light emission surface of the lens array 506, the operator may in some cases insert and remove the cleaning member 600 into and from the insertion portion 550*a* few times. When cleaning is performed by inserting and removing the cleaning member 600 into and from the insertion portion 550*a* few times, even if the cleaning portion 604 and the light emission surface of the lens array 506 become separated on the first insertion, it is only sufficient that the cleaning portion 604 rubs the light emission surface of the lens array 506 when removing the cleaning member 600 or on the second insertion. Taking the above into consideration, the attractive force described above may be about 100 gf or less as long as the magnet 602 provided on the front end side of the rod 601 emits magnetic force that maintains the state in which the cleaning portion 604 and the light emission surface of the lens array 506 are in contact with each other and the attractive force is functioning to attract the front end side of the rod 601 and the holding body 505 to each other.

Figure 14:
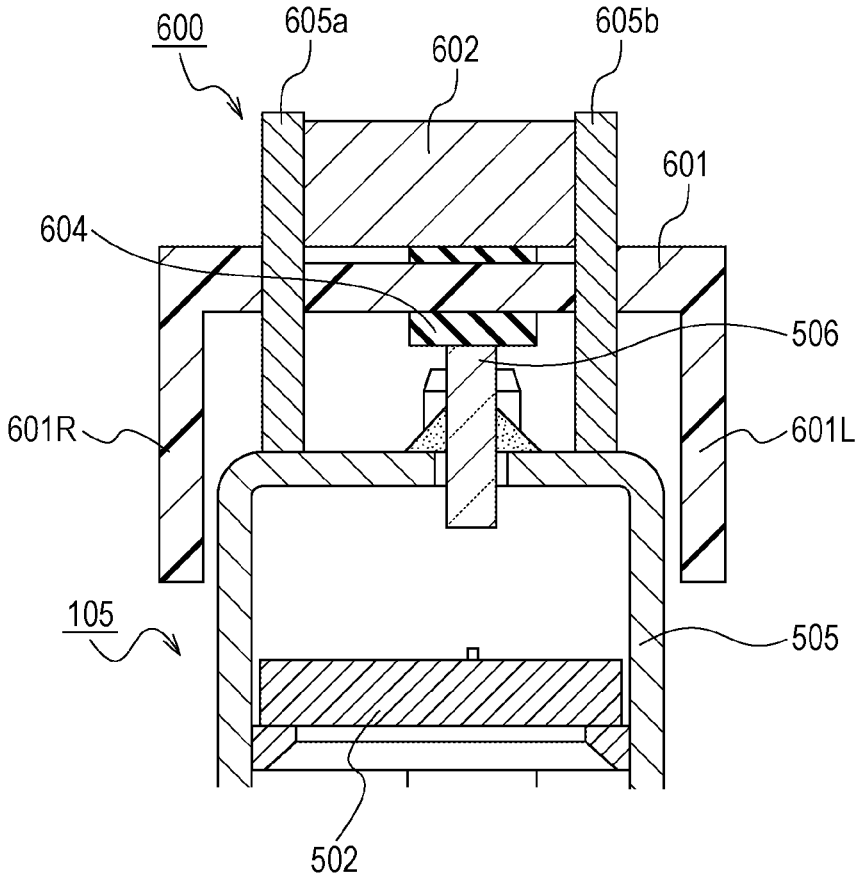
FIG. 14 is a diagram illustrating a state in which yokes provided in the cleaning member are in contact with a holding body.

FIG. 14 is a diagram illustrating the state in which the yoke 605*a* and the yoke 605*b* are in contact with the upper surface of the holding body 505. As illustrated in FIG. 14, the yoke 605*a* is disposed on the left side of the magnet 602 provided above the rod 601, and the yoke 605*b* is disposed on the right side of the magnet 602. Note that the right side of the magnet 602 herein denotes one side of a perpendicular direction that is perpendicular to both the longitudinal direction of the rod 601 and the optical axis direction of the lenses of the lens array 506. The left side of the magnet 602 denotes the other side of a perpendicular direction that is perpendicular to both the longitudinal direction of the rod 601 and the optical axis direction of the lenses of the lens array 506. The perpendicular direction and the left-right direction denote the same direction. The magnetic flux emitted by the magnet 602 passes through the yoke 605*a* and the yoke 605*b*, and is oriented towards the holding body 505. With the above, attractive force is generated in the yoke 605*a*, the yoke 605*b*, and the holding body 505.

When the light emission surface of the lens array 506 and the cleaning portion 604 oppose each other in the optical axis direction of the lens array 506, the yoke 605*a* and the yoke 605*b*, and the holding body 505 are attracted to each other by the magnetic force and are in contact with each other.

By having the yoke 605*a* and the yoke 605*b*, and the holding body 505 come in contact with each other and attract each other by magnetic force, force that draws the front end side of the rod 601 and the holding body 505 to each other also acts on the front end side of the rod 601 and the holding body 505. In other words, the magnet 602 emits magnetic force that generates force that pulls the magnet 602 itself and the holding body 505 to each other. With the above, the cleaning portion 604 provided on the front end side of the rod 601 also moves in the optical axis direction of the lens array 506 so as to approach the holding body 505. As illustrated in FIG. 14, when the yoke 605*a* and the yoke 605*b* are in contact with the holding body 505, the cleaning portion 604 is exposed to the lower side from the rod 601 to the extent at which the cleaning portion 604 is in contact with the light emission surface of the lens array 506. In the present embodiment, the protrusion amount of the cleaning portion 604 protruding to the lower side from the front end side of the rod 601 is about 3 mm. When the yoke 605*a* and the yoke 605*b* are in contact with the holding body 505, the cleaning portion 604 and the light emission surface of the lens array 506 are reliably in contact with each other. Specifically, 0.5 mm of the lower end of the cleaning portion 604 cleans the light emission surface of the lens array 506.

When the cleaning member 600 is in a state illustrated in FIG. 14, the cleaning portion 604 is in contact with the light emission surface of the lens array 506. In the above state, the cleaning portion 604 is flexed towards either the near side or the far side. Since the yokes 605 and the holding body 505 try to attract each other on the right side and the left side with respect to the cleaning portion 604, the cleaning portion 604 is urged against the light emission surface of the lens array 506. The state in which the cleaning portion 604 and the lens array 506 are in contact with each other in the up-down direction (the optical axis direction of the lenses of the lens array 506) is maintained in the above manner.

As illustrated in FIG. 14, a right lateral surface 601R of the rod 601 is located on the right side with respect to the holding body 505, and a left lateral surface 601L of the rod 601 is located on the left side with respect to the holding body 505. In other words, the right lateral surface 601R and the left lateral surface 601L of the rod 601 interpose the holding body 505 therebetween in the left-right direction. By so doing, movement of the cleaning member 600 with respect to the holding body 505 in the left-right direction, or the sub scanning direction, is restricted. A slight gap is formed between the right lateral surface 601R of the rod 601 and the holding body 505, and between the left lateral surface 601L of the rod 601 and the holding body 505. The cleaning member 600 is allowed to move in the left-right direction with respect to the holding body 505 to the extent of the above gaps. With the above, while coming in contact with the holding body 505 in the left-right direction, the cleaning member 600 can move smoothly.

Note that in the present embodiment, the width of the cleaning portion 604 in the left-right direction is about 2.5 mm. A sum of the width of the right lateral surface 601R of the rod 601 and the holding body 505 in the left-right direction, and a sum of the width of the left lateral surface 601L of the rod 601 and the holding body 505 in the left-right direction are each about 2.5 mm or less. Accordingly, even when the rod 601 moves in the left-right direction with respect to the holding body 505, the cleaning portion 604 does not move to the right side or the left side with respect to the light emission surface of the lens array 506. A state in which the cleaning portion 604 and the light emission surface of the lens array 506 are in contact with each other in the left-right direction is maintained in the above manner.

With the above, in a state in which the cleaning member 600 has been inserted into the insertion portion 550 from the outside of the apparatus main body by the user and in which the cleaning portion 604 and the light emission surface of the lens array 506 oppose each other in the optical axis direction of the lens array 506, the state in which the cleaning portion 604 and the light emission surface of the lens array 506 are in contact with each other is maintained. The light emission surface of the lens array 506 is cleaned by having the cleaning member 600 be inserted into and removed from the insertion portion 550 while maintaining the contact between the cleaning portion 604 and the light emission surface of the lens array 506.

Detailed Configuration Around Cleaning Portion

Figure 15A:
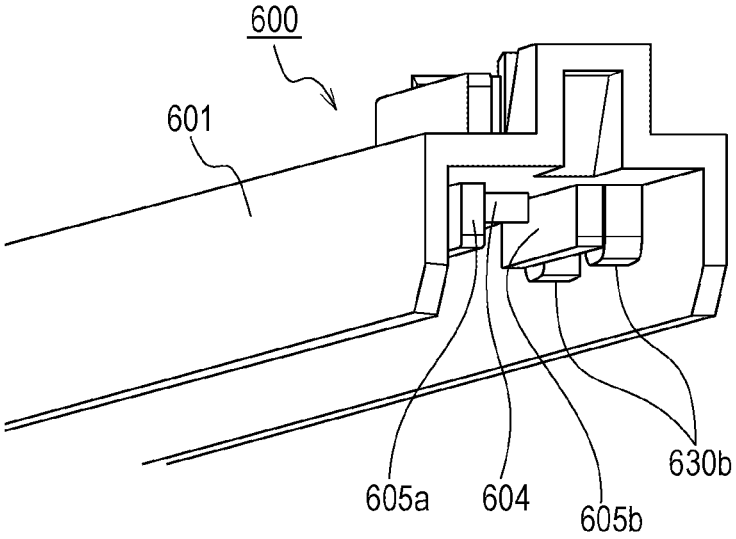
FIGS. 15A and 15B are diagrams illustrating an example of protruded portions provided in the cleaning member.
Figure 15B:
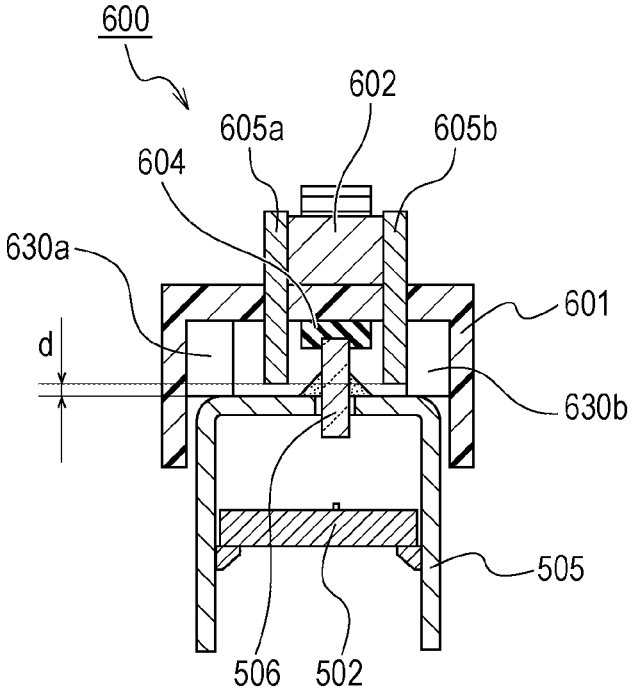

FIGS. 15A and 15B are diagrams illustrating a state in which protruded portions 630 (a protruded portion 630*a* and a protruded portion 630*b*) protruding more to the holding body 505 side than the yokes 605 are provided in the rod 601 so that the yokes 605 and the holding body 505 are contactless when the cleaning portion 604 and the light emission surface of the lens array 506 oppose each other in the optical axis direction of the lenses of the lens array 506. FIG. 15A is a perspective view of the front end side of the cleaning member 600, and FIG. 15B is a cross-sectional view of the front end side of the cleaning member 600 cut in a direction perpendicular to the longitudinal direction of the cleaning member 600. Note that the protruded portion 630*a* and the protruded portion 630*b* are examples of contact portions.

As in the configuration illustrated previously in FIG. 14, when the cleaning member 600 is inserted into and removed from the insertion portion 550 while the yokes 605 (the yoke 605*a* and the yoke 605*b*) and the holding body 505 are in contact with each other, one cannot dismiss the possibility of the yokes 605 scraping off the surface of the holding body 505. For example, with the aim to prevent rust, there are cases in which plating is performed on the surface of the holding body 505. The plating applied to the surface of the holding body 505 may come off when the metal yokes 605 rub the metal holding body 505. Furthermore, the yokes 605 themselves may become shaved. When metal powder created in the above manner adheres to the surface of the photosensitive drum 103, leaking may occur.

Accordingly, as illustrated in FIGS. 15A and 15B, the protruded portion 630*a* and the protruded portion 630*b* are formed on the front end side of the rod 601. The protruded portion 630*a* protrudes to the lower side, or the holding body 505 side, with respect to the yoke 605*a*. Similarly, the protruded portion 630*b* protrudes to the lower side, or the holding body 505 side, with respect to the yoke 605*b*. When the protruded portion 630*a* and the protruded portion 630*b* are in contact with the holding body 505, a gap is formed between the holding body 505 and each yoke 605 in the up-down direction (the optical axis direction of the lenses of the lens array 506). In other words, a gap is formed between each yoke 605 and the holding body 505 in the up-down direction. In other words, by having the protruded portion 630*a* and the protruded portion 630*b* contact the holding body 505, a contactless state between the yokes 605 and the holding body 505 can be maintained.

The protruded portion 630*a* and the protruded portion 630*b* are both, same as the rod 601, formed of resin. Accordingly, even when the protruded portion 630*a* and the protruded portion 630*b* rub the metal holding body 505, the protruded portion 630*a* and the protruded portion 630*b* do not damage the surface of the holding body 505 as the yokes 605 damage the holding body 505. Furthermore, the frictional force generated when the resin protruded portions 630 rub the metal holding body 505 is smaller than the frictional force generated when the metal yokes 605 rub the metal holding body 505. Accordingly, compared with when the cleaning member 600 is moved while the yokes 605 and the holding body 505 are in contact with each other, the force needed to insert and remove the cleaning member 600 into and from the insertion portion 550 is smaller when the cleaning member 600 is moved while the protruded portions 630 and the holding body 505 are in contact with each other and the yokes 605 and the holding body are not in contact with each other.

In the present embodiment, since a resin with high sliding property, such as a polyacetal resin, is used for the protruded portions 630, the cleaning operation can be performed smoothly. Note that the distal ends of the protruded portions 630 that are in contact with the holding body 505 alone may be formed of polyacetal resin, and the other portions may be formed of acrylonitrile-butadiene-styrene (ABS) resin or the like.

Furthermore, rather than with the protruded portions 630, direct contact between the yokes 605 and the holding body 505 may be prevented by adhering a resin seal (an example of the contact portion) on the holding body 505 side of each yoke 605. By so doing, the yokes 605 can be prevented from rubbing the holding body 505, and the plating on the holding body 505 can be suppressed from coming off and shaving of the yokes 605 themselves can be reduced.

As illustrated in FIG. 15B, in the present embodiment, the distal end surfaces of the protruded portion 630*a* and the protruded portion 630*b* of the rod 601 protrude to the holding body 505 side with respect to the yoke 605*a* and the yoke 605*b*. Furthermore, a clearance (a gap) d is formed between the distal end surface of each yoke 605 and the holding body 505.

Figure 16:
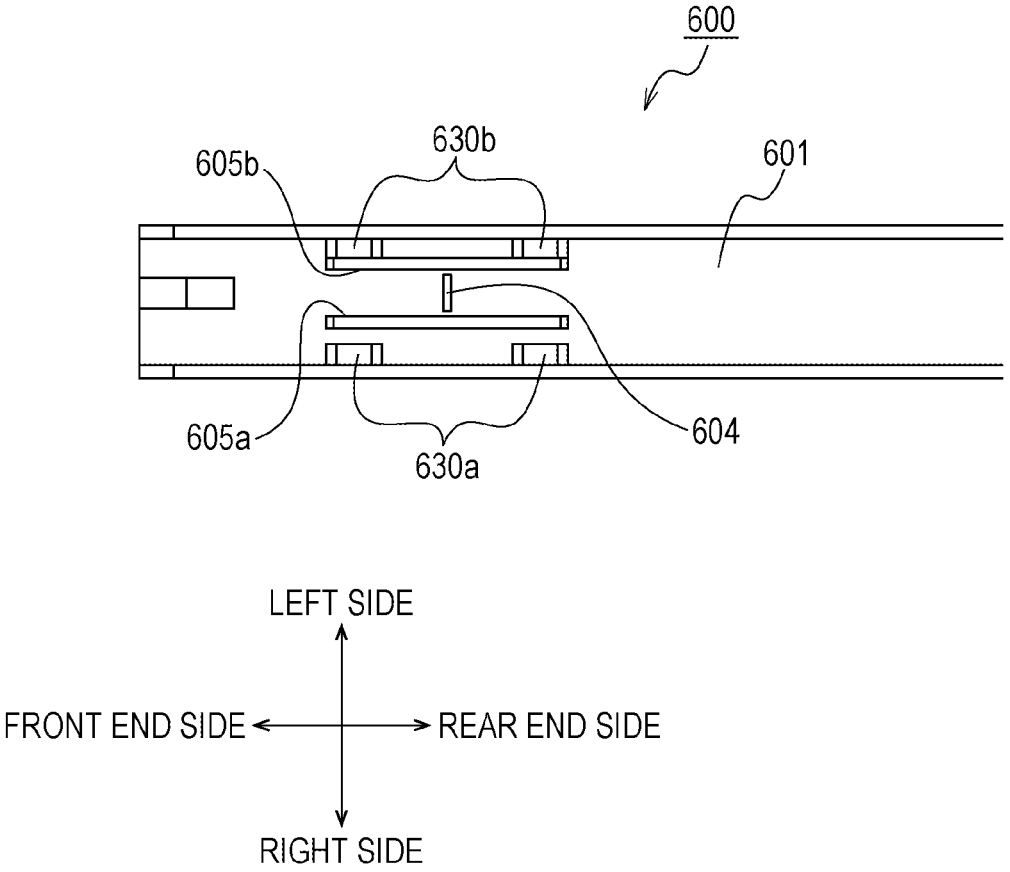
FIG. 16 is a diagram illustrating a positional relationship between the cleaning portion and the protruded portions.

FIG. 16 is a diagram of the front end side of the rod 601 provided with the protruded portions 630, viewed from the lower side. As illustrated in FIG. 16, the yoke 605*a* is disposed on the left side with respect to the cleaning portion 604, and the yoke 605*b* is disposed on the right side with respect to the cleaning portion 604. Furthermore, the protruded portion 630*a* is formed on the rod 601 and on the left side with respect to the yoke 605*a*, and the protruded portion 630*b* is formed on the rod 601 and on the right side with respect to the yoke 605*b*. In other words, the protruded portions 630 are provided on the rod 601 so as to interpose the yokes 605 and the cleaning portion 604 in the left-right direction.

Furthermore, as illustrated in FIG. 16, the protruded portion 630*a* includes two protrusions provided separate from each other. The two protrusions are disposed separate from each other in the longitudinal direction of the rod 601. Similarly, the protruded portion 630*b* includes two protrusions provided separate from each other. The two protrusions are disposed separate from each other in the longitudinal direction of the rod 601. As the two protrusions included in the protruded portion 630*a*, a first protrusion is provided on the front end side of the rod 601 with respect to the cleaning portion 604, and a second protrusion is provided on the rear end side of the rod 601 with respect to the cleaning portion 604. Similarly, as the two protrusions included in the protruded portion 630*b*, a first protrusion is provided on the front end side of the rod 601 with respect to the cleaning portion 604, and a second protrusion is provided on the rear end side of the rod 601 with respect to the cleaning portion 604. In other words, by adding the two protrusions included in the protruded portion 630*a* and the two protrusions included in the protruded portion 630*b*, the rod 601 is provided with protrusions at four portions to prevent the yokes 605 and the holding body 505 from coming in contact with each other. By having the protrusions come in contact with the holding body 505, gaps are formed between the yokes 605 and the holding body 505, which brings the yokes 605 and the holding body 505 in a non-contact state.

Figure 17:
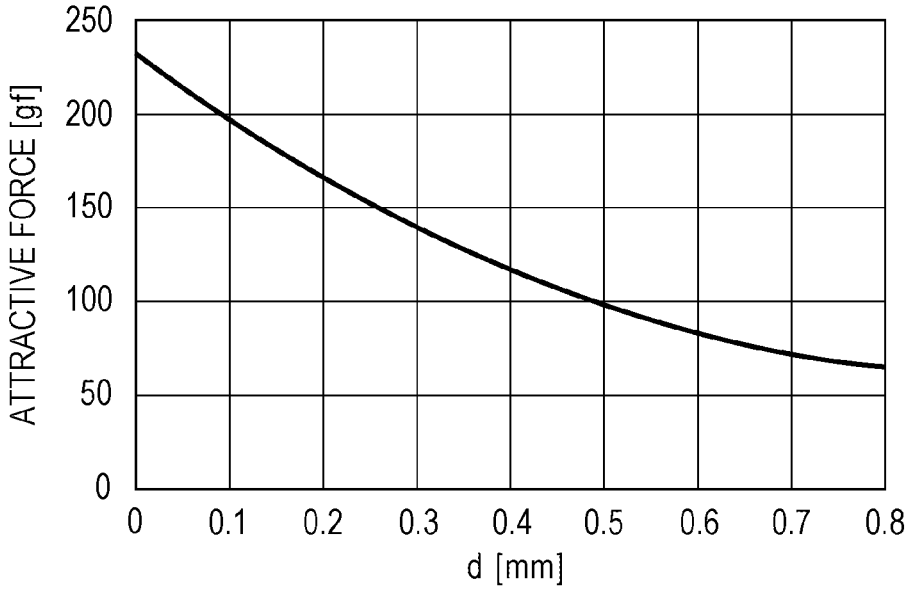
FIG. 17 is a graph of force of the cleaning member attracting the holding body against the gap between the yoke and the holding body.

FIG. 17 is a graph illustrating a result of an experiment conducted on the relationship between the gap d between the yoke 605 and the holding body 505, and the force drawing the magnet 602 and the holding body 505 to each other. It can be understood from the graph that as the gap d was made smaller, the force drawing the magnet 602 and the holding body 505 to each other increased exponentially.

As the force drawing the magnet 602 and the holding body 505 to each other became larger, the contact between the cleaning portion 604 and the light emission surface of the lens array 506 was established more reliably. On the other hand, the force needed to insert and remove the cleaning member 600 into and from the insertion portion 550 became larger.

When the force drawing the magnet 602 and the holding body 505 to each other became smaller, while the force needed to insert and remove the cleaning member 600 into and from the insertion portion 550 became smaller, one cannot dismiss the possibility of the cleaning portion 604 becoming easily detached from the holding body 505. Based on the experiment conducted by the inventors, the attractive force of the magnet 602 acting on the holding body 505 was set to about 100 gf, and the protrusion amount of the protruded portions 630 from the rod 601 was set so that the gap d was 0.5 mm.

Figure 18A:
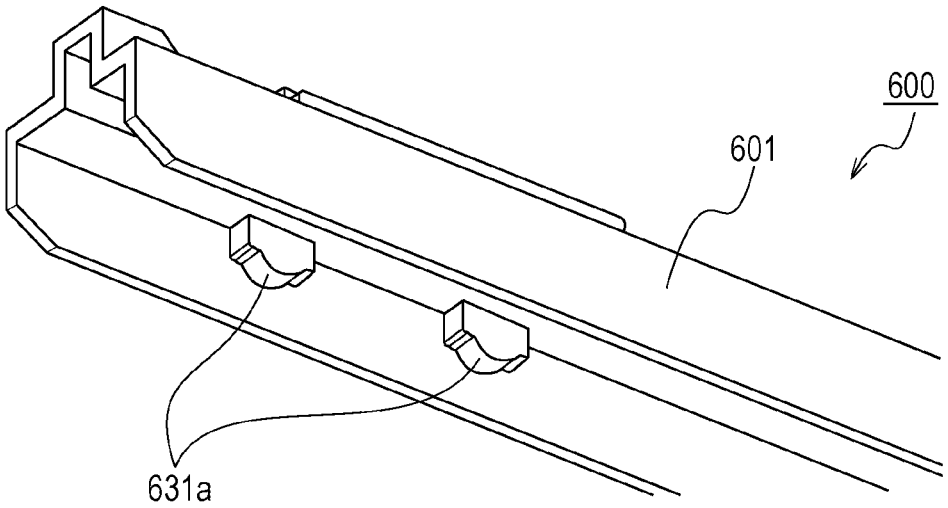
FIGS. 18A and 18B are diagrams illustrating other examples of the protruded portions provided in the cleaning member.
Figure 18B:
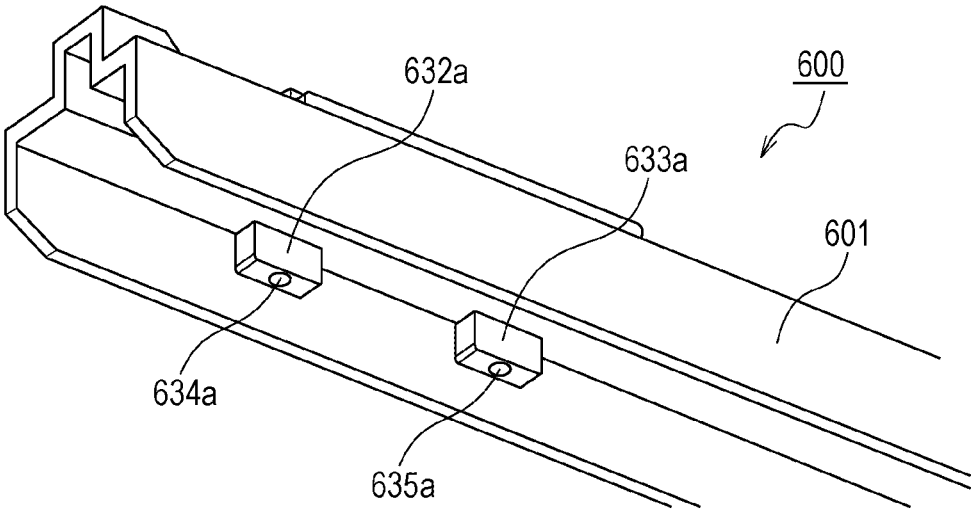

FIGS. 18A and 18B illustrate configurations of the protruded portions 630. In order to simplify the description, the magnet 602 and the yokes 605 are not illustrated in the drawings, only protruded portions 631*a* corresponding to the protruded portions 630*a* are illustrated in FIG. 18A, and only protruded portions 632*a* and 633*a* corresponding to the protruded portions 630*a* are illustrated in FIG. 18B.

As illustrated in FIG. 18A, a portion of a surface of each protruded portion 63 la on the holding body 505 side has a cylindrical shape. With the above configuration, since the portion in contact with the holding body 505 is a cylindrical outer peripheral surface and is linear, the rub resistance can be reduced and the cleaning member 600 can be moved in a further smooth manner.

Furthermore, the protruded portion 630*a* may be configured as in FIG. 18B. A hemispherical protrusion 634*a* is formed on the holding body 505 side of the protruded portion 632*a* illustrated in FIG. 18B. A hemispherical protrusion 635*a* is formed on the holding body 505 side of the protruded portion 633*a*. In the above modification, the hemispherical protrusions 634*a* and 635*a* are examples of the contact portions.

As illustrated in FIG. 18B, the protrusion 634*a* is formed closer to the right side in the protruded portion 632*a*. Furthermore, the protrusion 635*a* is formed closer to the left side in the protruded portion 633*a*. In other words, in the longitudinal direction of the rod 601, the protrusion 634*a* and the protrusion 635*a* are disposed so as to be offset with each other in the left-right direction. By having the protrusion 634*a* and the protrusion 635*a* have such a positional relationship, when cleaning work is performed using the cleaning member 600, the portion where the protrusion 634*a* and the holding body 505 rub each other and a portion where the protrusion 635*a* and the holding body 505 rub each other are offset in the left-right direction. In other words, when the cleaning member 600 is inserted into the insertion portion 550, a possibility of the portion in the upper surface of the holding body 505 where the protrusion 634*a* has rubbed being further rubbed by the protrusion 635*a* can be reduced. With the above, when the operation of inserting and removing the cleaning member 600 into and from the insertion portion 550 is repeated, the abrasion damage that the holding body 505 receives can be dispersed.

Positional Relationship Between Yoke and Protruded Portion

Figure 19:
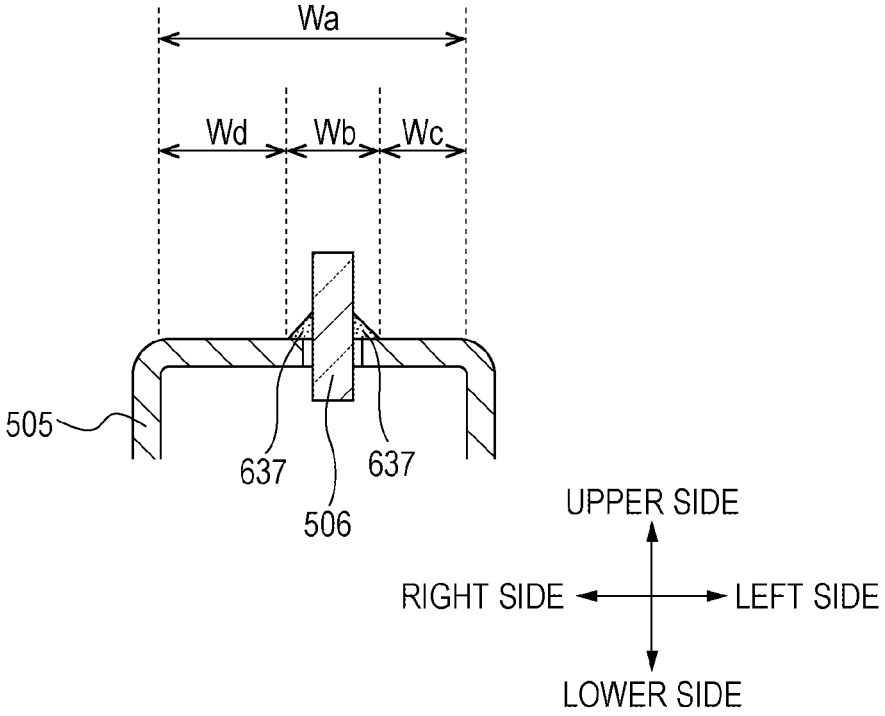
FIG. 19 is a diagram illustrating dimensions of the holding body in a left-right direction.
Figure 20A:
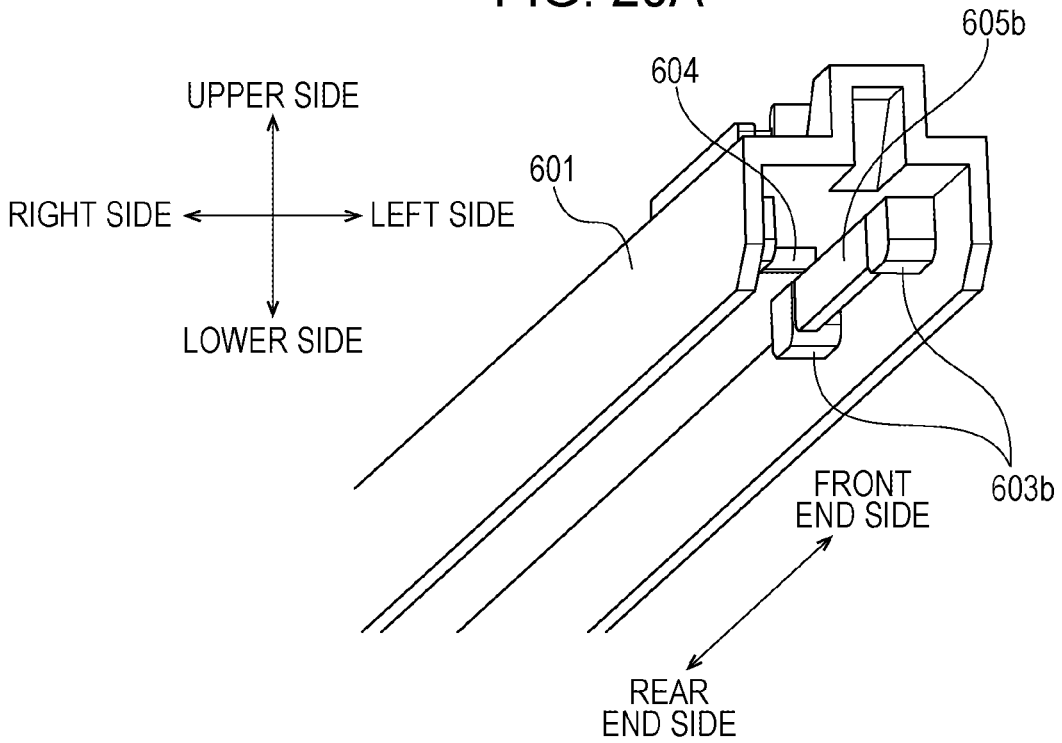
FIGS. 20A and 20B are diagrams illustrating a positional relationship between the yokes and the protruded portions.
Figure 20B:
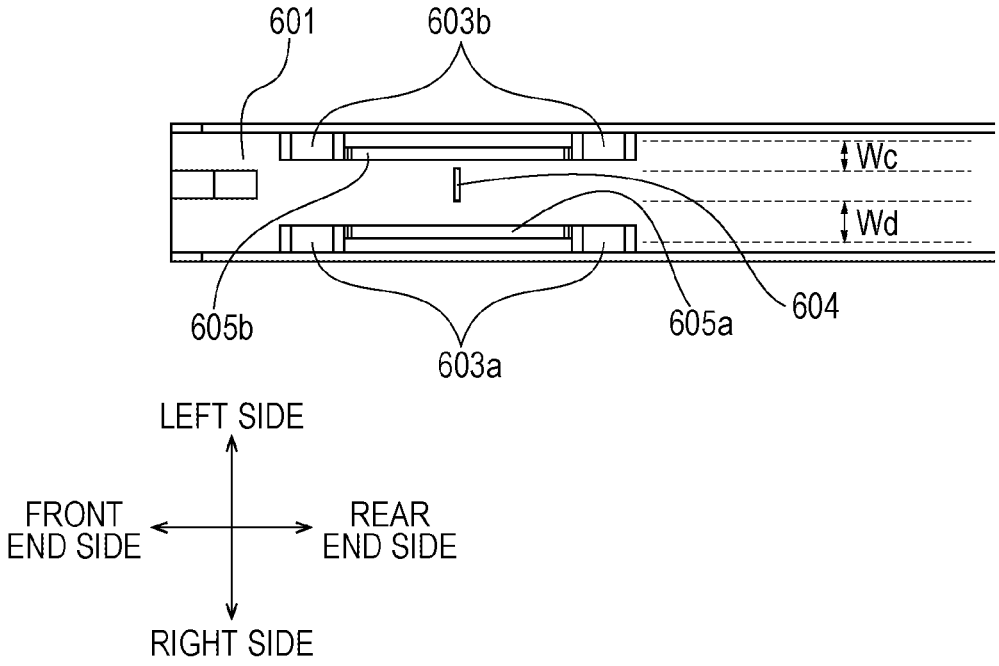

Referring to FIGS. 19, 20A, and 20B, the positional relationship between the yokes 605 and the protruded portions 603*a* (603*b*) will be described in further detail.

FIG. 19 is a diagram illustrating dimensions of the holding body 505 in the left-right direction. The lens array 506 is attached to the upper surface of the holding body 505, and the lens array 506 is fixed to the holding body 505 with an adhesive agent 637.

As illustrated in FIG. 19, in the present embodiment, Wa=10.5 mm, Wb=3.2 mm, We=2.9 mm, and Wd=4.4 mm are satisfied, where a width of the holding body 505 in the left-right direction is Wa, a width of the upper surface of the holding body 505 from a left end portion to the adhesive agent 637 applied on a left wall of the lens array 506 is Wd, a width of the upper surface of the holding body 505 from a right end portion to the adhesive agent 637 applied to a right wall of the lens array 506 is Wc, and a width of the lens array 506 in the left-right direction including the adhesive agents 637 is Wb. In the case of the image forming apparatus 1 according to the present embodiment, by setting Wa to Wd as described above, when the holding body 505 is moved to the exposing position and the retracted position with the first link mechanism 530 and the second link mechanism 540, the holding body 505 can be prevented from coming in contact with the charger 104 and the developing device 106. As described above, the dimensions of the holding body 505 are values that are determined by the disposed positions of the charger 104 and the developing device 106 that are disposed around the holding body 505, and by the distances between the charger 104 and the developing device 106, and the holding body 505. Accordingly, when the disposed positions of the charger 104 and the developing device 106 are different, the dimensions of the holding body 505 may change as well. In other words, the dimensions of the holding body 505 do not have to be limited to the values Wa to Wd described above.

Referring to FIGS. 20A and 20B, disposing positions of the yokes 605 and the protruded portions 603*a* (603*b*) in the cleaning member 600 will be considered. FIGS. 20A and 20B are diagrams illustrating the positional relationship between the yokes 605 and the protruded portions 603.

For example, as illustrated in FIG. 15B, the yoke 605*a* and the yoke 605*b* protrude from the upper surface portion of the rod 601 to the holding body 505 side. Specifically, the yoke 605*a* and the yoke 605*b* protrude to the lower side with respect to the cleaning portion 604. Accordingly, in a state in which the cleaning member 600 is inserted in the insertion portion 550, when the yokes 605 are located inside the width Wb in FIG. 19, the yokes 605 come in contact with the lens array 506. In order to prevent the above, when the cleaning portion 604 is rubbing the light emission surface of the lens array 506, the yoke 605*a* is provided in the rod 601 so as to be located inside the width Wd in the holding body 505, and the yoke 605*b* is provided in the rod 601 so as to be located inside the width We in the holding body 505.

Furthermore, in a similar manner, the protruded portion 603*a* needs to be provided in the rod 601 so as to be located inside the width Wd in the holding body 505 as well, and the protruded portion 603*b* needs to be provided in the rod 601 so as to be located inside the width We in the holding body 505 as well.

In consideration of the above, in the example in FIGS. 15A and 15B, for example, the yoke 605*a* and the protruded portion 630*a* are arranged side by side in the left-right direction and, similarly, the yoke 605*b* and the protruded portion 630*b* are arranged side by side in the left-right direction. However, when the yoke 605*a* and the protruded portion 630*a* are provided in the rod 601 so as to be arranged side by side in the left-right direction, the yoke 605*a* and the protruded portion 630*a* both have to be contained inside the width Wd. Similarly, when the yoke 605*b* and the protruded portion 630*b* are provided in the rod 601 so as to be arranged side by side in the left-right direction, the yoke 605*b* and the protruded portion 630*b* both have to be contained inside the width Wc.

In order to fabricate such a configuration, the width of the rod 601 in the left-right direction and the width of the holding body 505 in the left-right direction need to be wide, which cannot be said as an optimum configuration in view of miniaturization of the cleaning member 600 and the holding body 505.

Accordingly, as illustrated in FIGS. 20A and 20B, an arrangement in which portions of the yokes 605 and portions of the protruded portions 603*a* (603*b*) overlap each other in the longitudinal direction of the rod 601 is considered. FIG. 20A is a schematic perspective view of the front end side of the rod 601. As illustrated in FIG. 20A, the protruded portion 603*b* is disposed on the front end side of the rod 601 with respect to the yoke 605*b* and on the rear end side of the rod 601 with respect to the yoke 605*b*. Specifically, the first protrusion included in the protruded portion 603*b* protrudes to the holding body 505 side with respect to the yoke 605*b* at a portion on the front end side of the rod 601 with respect to the yoke 605*b*. Furthermore, while not illustrated in FIG. 20A, the first protrusion protrudes to the holding body 505 side with respect to the yoke 605*a* at a portion on the front end side of the rod 601 with respect to the yoke 605*a*.

FIG. 20B is a diagram of the cleaning member 600 viewed from the lower side. As illustrated in FIG. 20B, the yoke 605*a* is located on the left side with respect to the cleaning portion 604, and the yoke 605*b* is located on the right side with respect to the cleaning portion 604. The first protrusion included in the protruded portion 603*a* is located on the front end side of the rod 601 with respect to the yoke 605*a*, and the second protrusion included in the protruded portion 603*a* is located on the rear end side of the rod 601 with respect to the yoke 605*a*. Furthermore, the first protrusion included in the protruded portion 603*b* is located on the front end side of the rod 601 with respect to the yoke 605*b*, and the second protrusion included in the protruded portion 603*b* is located on the rear end side of the rod 601 with respect to the yoke 605*b*. Specifically, the yoke 605*a* is interposed between the two protrusions, which are included in the protruded portion 603*a*, in the longitudinal direction of the rod 601. Similarly, the yoke 605*b* is interposed between the two protrusions, which are included in the protruded portion 603*b*, in the longitudinal direction of the rod 601. More specifically, the yoke 605*a* and the protruded portion 603*a* are disposed side by side in the longitudinal direction of the rod 601, and the yoke 605*b* and the protruded portion 603*b* are disposed side by side in the longitudinal direction of the rod 601. By disposing the yoke 605 and the protruded portion 603*a* (603*b*) in the above manner, the yoke 605*a* and the protruded portion 603*a* can be disposed inside the width Wc, and the yoke 605*b* and the protruded portion 603*b* can be disposed inside the width Wd without overly increasing the width of the cleaning member 600.

While the present invention has been described with reference to embodiments, it is to be understood that the invention is not limited to the disclosed embodiments. It will of course be understood that this invention has been described above by way of example only, and that modifications of detail can be made within the scope of this invention.

This application claims the benefit of Japanese Patent Application No. 2019-046341, filed Mar. 13, 2019, which is hereby incorporated by reference herein in its entirety.

What is claimed is:

1. A cleaning member that is used in an image forming apparatus and configured to be inserted into the image forming apparatus from outside the image forming apparatus, the image forming apparatus including a holding body comprising a metal magnetic body holding a substrate on which a plurality of light emitting elements configured to emit light to expose a photosensitive drum are aligned in a rotational axis direction of the photosensitive drum and holding lenses configured to collect the light emitted from the light emitting elements to the photosensitive drum, the cleaning member comprising:

a rod formed of resin;

a cleaning portion attached to the rod to clean a light emission surface of each lens, the cleaning portion configured to move together with the rod on insertion of the cleaning member into the image forming apparatus and to oppose the light emission surface in an optical axis direction of the lenses;

a magnet attached to the rod, the magnet emitting a magnetic field to generate a magnetic force to draw the holding body thereto, in the case that the cleaning member is inserted in the image forming apparatus, so that the cleaning portion opposing the light emission surface maintains contact with the light emission surface;

a yoke member attached to the rod and in contact with the magnet, wherein in a state in which the cleaning member is inserted in the image forming apparatus, the yoke member is configured to protrude, with respect to the magnet, in a direction of an optical axis of the lenses towards a side on which the holding body is disposed; and a contact portion configured, in the state in which the cleaning member is inserted in the image forming apparatus, to protrude, with respect to the yoke member, in the optical axis direction towards the side on which the holding body is disposed, and configured to be in contact with the holding body.

2. The cleaning member according to claim 1, wherein the yoke member includes a first yoke piece and a second yoke piece, and wherein the first yoke piece is attached to the rod and is configured to be in contact with one side of the magnet in a perpendicular direction perpendicular to both a longitudinal direction of the rod and the optical axis direction, and the second yoke piece is attached to the rod and is configured to be in contact with another side of the magnet in the perpendicular direction.

3. The cleaning member according to claim 2, further comprising:

a first protrusion attached to the rod, wherein in the state in which the cleaning member is inserted in the image forming apparatus, the first protrusion is configured to protrude, with respect to the first yoke piece, in the optical axis direction towards the side on which the holding body is disposed, and a second protrusion attached to the rod, wherein in the state in which the cleaning member is inserted in the image forming apparatus, the second protrusion is configured to protrude, with respect to the second yoke piece, in the optical axis direction towards the side on which the holding body is disposed, wherein the contact portion is provided on the first protrusion and on the second protrusion.

4. The cleaning member according to claim 3, wherein at least a portion of the first protrusion overlaps the first yoke piece in the longitudinal direction of the rod, and wherein at least a portion of the second protrusion overlaps the second yoke piece in the longitudinal direction of the rod.

5. The cleaning member according to claim 1, wherein the rod comprises a protrusion configured, in a state in which the cleaning member is inserted in the image forming apparatus, to protrude, with respect to the yoke member, in the optical axis direction towards the side on which the holding body is disposed, the contact portion being arranged on the protrusion.

6. The cleaning member according to claim 5, wherein at least a portion of the protrusion overlaps the yoke member in a longitudinal direction of the rod.

7. The cleaning member according to claim 1, wherein, in the state in which the cleaning member is inserted in the image forming apparatus, the magnet is attached to a side of the rod on which the photosensitive drum is disposed, the rod being located between the magnet and the holding body in the optical axis direction.

8. The cleaning member according to claim 1, wherein the magnet and the cleaning portion are attached to a first end side of the rod in a longitudinal direction of the rod, and wherein the cleaning member is configured to be inserted into the image forming apparatus from the first end side of the rod.

9. The cleaning member according to claim 8, wherein in a direction extending from a second end side of the rod in the longitudinal direction towards the first end side of the rod in the longitudinal direction, at least a portion of the magnet is located downstream of the cleaning portion.

10. The cleaning member according to claim 1, wherein the cleaning portion is a flexible blade.

11. An image forming apparatus comprising:

a photosensitive drum configured to rotate;

a holding body comprising a metal magnetic body holding a substrate on which a plurality of light emitting elements configured to emit light to expose the photosensitive drum are aligned in a rotational axis direction of the photosensitive drum and holding lenses configured to collect the light emitted from the light emitting elements to the photosensitive drum; and an insertion portion configured to receive a cleaning member according to claim 1, inserted from outside the image forming apparatus, wherein in an insertion direction of the cleaning member, the insertion portion is provided upstream of a light emission surface of the light emitting elements.

12. The image forming apparatus according to claim 11, wherein the insertion portion is provided as a member separate to the holding body.

13. The image forming apparatus according to claim 11, wherein the holding body is a metal plate on which bending has been performed.

14. The image forming apparatus according to claim 11, wherein the light emitting elements are LEDs.

15. The image forming apparatus according to claim 11, wherein the light emitting elements are OLEDs.

* * * * *